US011493873B2

(12) United States Patent
Ichikawa et al.

(10) Patent No.: US 11,493,873 B2
(45) Date of Patent: Nov. 8, 2022

(54) LAYER TRANSFER DEVICE

(71) Applicant: BROTHER KOGYO KABUSHIKI KAISHA, Nagoya (JP)

(72) Inventors: Tomoya Ichikawa, Nagoya (JP); Ryosuke Sakai, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/352,704

(22) Filed: Jun. 21, 2021

(65) Prior Publication Data

US 2021/0311426 A1 Oct. 7, 2021

Related U.S. Application Data

(63) Continuation of application No. PCT/JP2019/020693, filed on May 24, 2019.

(30) Foreign Application Priority Data

Dec. 28, 2018 (JP) ..... JP2018-246433
Jan. 23, 2019 (JP) ..... JP2019-008883
Jan. 28, 2019 (JP) ..... JP2019-011989

(51) Int. Cl.
*G03G 15/00* (2006.01)
*G03G 15/22* (2006.01)
(Continued)

(52) U.S. Cl.
CPC ..... *G03G 15/6582* (2013.01); *G03G 15/2021* (2013.01); *G03G 15/2032* (2013.01);
(Continued)

(58) Field of Classification Search
CPC ..... G03G 15/6582; G03G 15/2021; G03G 15/2032; G03G 21/16; G03G 2215/00801; B41F 16/006
See application file for complete search history.

(56) References Cited

U.S. PATENT DOCUMENTS 8,568,044 B2 10/2013 Murata et al.
8,810,619 B2 8/2014 Kaneoya et al.
(Continued)

FOREIGN PATENT DOCUMENTS

CN 101077664 A 11/2007
CN 101870207 A 10/2010
(Continued)

OTHER PUBLICATIONS

International Search Report issued in PCT/JP2019/020693, dated Jul. 2, 2019.
(Continued)

*Primary Examiner* — Joseph S Wong
(74) *Attorney, Agent, or Firm* — Merchant & Gould P.C.

(57) ABSTRACT

Disclosed is a layer transfer device for transferring a transfer layer onto a toner image formed on a sheet, in which a replacement of a film cartridge is easy for a user. The layer transfer device includes a housing, a film cartridge, and a holder. The film cartridge includes a supply reel including a supply shaft on which a multilayer film including a supported layer including a transfer layer, and a supporting layer supporting the supported layer is wound, and a take-up reel including a take-up shaft on which to take up the multilayer film. The holder supports the film cartridge, and is installable into and removable from the housing while supporting the film cartridge.

59 Claims, 23 Drawing Sheets

(51) Int. Cl.
*G03G 21/16* (2006.01)
*G03G 15/20* (2006.01)
*B41F 16/00* (2006.01)

(52) U.S. Cl.
CPC ..... *G03G 15/221* (2013.01); *G03G 21/16* (2013.01); *B41F 16/006* (2013.01); *G03G 2215/00801* (2013.01)

(56) References Cited

U.S. PATENT DOCUMENTS

| | | | | |
|---|---|---|---|---|
| 9,381,764 | B2 | 7/2016 | Ohta | |
| 9,498,996 | B2 | 11/2016 | Ohta | |
| 9,656,478 | B2 | 5/2017 | Ohta | |
| 2001/0046399 | A1 | 11/2001 | Hayashi | |
| 2002/0024583 | A1 | 2/2002 | Hayashi | |
| 2004/0007331 | A1 | 1/2004 | Tamai et al. | |
| 2007/0269247 | A1 | 11/2007 | Motoki | |
| 2010/0272488 | A1 | 10/2010 | Murata et al. | |
| 2012/0027494 | A1 | 2/2012 | Kawashima et al. | |
| 2013/0250026 | A1 | 9/2013 | Kaneoya et al. | |
| 2015/0283834 | A1 | 10/2015 | Ohta | |
| 2016/0250874 | A1 | 9/2016 | Ohta | |
| 2017/0021637 | A1 | 1/2017 | Ohta | |
| 2021/0318656 | A1* | 10/2021 | Ichikawa | G03G 15/6582 |

FOREIGN PATENT DOCUMENTS

| | | | | | |
|---|---|---|---|---|---|
| CN | 103228452 | A | | 7/2013 | |
| CN | 104507695 | A | | 4/2015 | |
| CN | 104827786 | A | | 8/2015 | |
| JP | 6-54667 | U | | 7/1994 | |
| JP | 7-140820 | A | | 6/1995 | |
| JP | 7-290685 | A | | 11/1995 | |
| JP | 8-318614 | A | | 12/1996 | |
| JP | 2001-1619 | A | | 1/2001 | |
| JP | 2001-30465 | A | | 2/2001 | |
| JP | 2001-30466 | A | | 2/2001 | |
| JP | 2001-130133 | A | | 5/2001 | |
| JP | 2001-277624 | A | | 10/2001 | |
| JP | 2002-120960 | A | | 4/2002 | |
| JP | 2004-42943 | A | | 2/2004 | |
| JP | 2006-52006 | A | | 2/2006 | |
| JP | 2007-136893 | A | | 6/2007 | |
| JP | 2008-1087 | A | | 1/2008 | |
| JP | 2009-119631 | A | | 6/2009 | |
| JP | 2011215616 | A | * | 10/2011 | G03G 15/6582 |
| JP | 2012-30946 | A | | 2/2012 | |
| JP | 2012048221 | A | * | 3/2012 | G03G 15/6585 |
| JP | 2012215836 | A | * | 11/2012 | G03G 15/0189 |
| JP | 2018-93599 | A | | 6/2018 | |

OTHER PUBLICATIONS

International Preliminary Report on Patentability and Written Opinion of the International Searching Authority issued in corresponding International Patent Application No. PCT/JP2019/020693, dated Jun. 16, 2021.

International Preliminary Report on Patentability and Written Opinion of the International Searching Authority issued in corresponding International Patent Application No. PCT/JP2019/020785, dated Jun. 16, 2021.

International Search Report issued in International Patent Application No. PCT/JP2019/020785, dated Jul. 2, 2019.

First Office Action issued in corresponding Chinese Patent Application No. 201980086384.4, dated May 9, 2022.

Extended European Search Report (EESR) in counterpart European Patent Application No. 19903205.3, dated Sep. 7, 2022.

* cited by examiner (a)

(b)

LAYER TRANSFER DEVICE

CROSS-REFERENCE TO RELATED APPLICATION(S)

This application is a continuation application of International Application No. PCT/JP2019/020693 filed on May 24, 2019, and claims priority from Japanese Patent Application Nos. 2018-246433, 2019-008883, 2019-011989, filed on Dec. 28, 2018, Jan. 23, 2019 and Jan. 28, 2019, respectively, the disclosure of which is incorporated herein by reference in their entirety.

TECHNICAL FIELD

This disclosure relates to a layer transfer device for transferring a transfer layer onto a toner image formed on a sheet.

BACKGROUND ART

A film unit comprising a supply reel and a take-up reel on which a multilayer film having a transfer layer included therein is wound, and configured to be installable into and removable from a main housing of a layer transfer device is hitherto known in the art. In this art, the supply reel and the take-up reel are combined together with a multilayer film into a cartridge that is replaceable.

SUMMARY

However, in the prior art, the cartridge is configured to be integral with a frame on which a multilayer film is wound; thus, the cost of the cartridge as a consumable article could possibly add up.

It would be desirable to provide a cartridge accommodating a supply reel and a take-up reel together with a multilayer film to thereby lighten the user's labor for replacing the multilayer film, as well as to reduce the size and cost of the cartridge as a consumable article.

Against the backdrop described above, a layer transfer device for transferring a transfer layer onto a toner image formed on a sheet is disclosed. The layer transfer device comprises a housing, a film cartridge, and a holder. The film cartridge comprises: a supply reel including a supply shaft on which a multilayer film including a supported layer including a transfer layer, and a supporting layer supporting the supported layer is wound; and a take-up reel including a take-up shaft on which to take up the multilayer film. The holder is configured to support the film cartridge, and is installable into and removable from the housing while supporting the film cartridge.

According to this aspect and illustrative, non-limiting embodiments, which will be described later in detail, of the layer transfer device, the holder supporting the film cartridge is installable into and removable from the housing; therefore, the installation and removal of the film cartridge is easy, and the size and cost of the film cartridge as a consumable article can be reduced.

DESCRIPTION OF EMBODIMENTS

A description will be given of a first embodiment with reference made to the drawings where appropriate. In the following description, a general setup of a layer transfer device will be briefly described at the outset, and a configuration of a film unit will be described thereafter.

Figure 1:
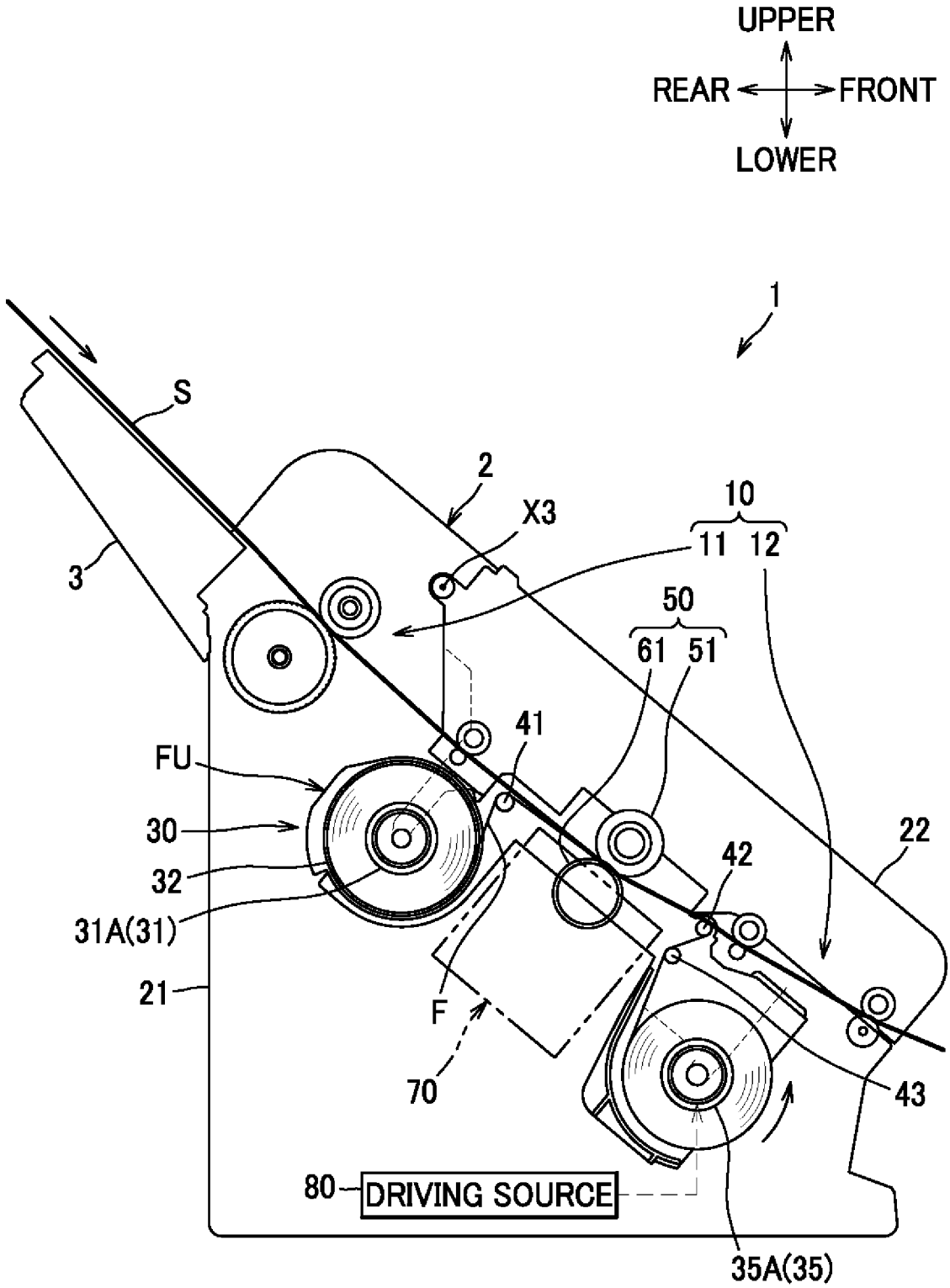
FIG. 1 is a diagram showing a layer transfer device in which a film unit is installed, according to a first embodiment.

In the following description, directions will be referred to as directions shown in FIG. 1. That is, the right-hand side of FIG. 1 is referred to as "front", the left-hand side of FIG. 1 as "rear", the front side of the drawing sheet of FIG. 1 as "left", and the back side of the drawing sheet of FIG. 1 as "right". Similarly, upward/downward directions (upper/lower sides) of FIG. 1 are referred to as "upward/downward (upper/lower)".

As shown in FIG. 1, a layer transfer device 1 is a device for post-processing to be subjected to a sheet S on which a toner image is formed by an image forming apparatus, for example, a laser printer or the like; more specifically, a device for transferring foil such as of gold, aluminum or the like onto the toner image on the sheet S. The layer transfer device 1 includes a housing 2, a sheet tray 3, a sheet conveyor unit 10, a film supply unit 30, and a transfer unit 50.

The housing 2 is made of plastic or the like, and includes a housing main body 21 and a cover 22. The housing main body 21 has a third opening 21A at its upper side (see FIG. 2). The third opening 21A is an opening for allowing a film unit FU as will be described later to be installed into or removed from the housing main body 21, and thus is configured to allow the film unit FU to pass therethrough. The cover 22 is a member for opening and closing the third opening 21A. A rear end portion of the cover 22 is rotatably supported by the housing main body 21. To be more specific, the cover 22 is configured to be rotatable relative to the housing main body 21 about a rotation axis X3 oriented along a direction parallel to a rotation axis of a supply reel 31 which will be described later when a holder 100 which will be described later supporting a film cartridge 200 which will be described later is located in place in the housing main body 21.

The sheet tray 3 is a tray on which sheets S such as paper, OHP film, etc., are placed. The sheet tray 3 is provided at a rear portion of the housing 2. The sheets S, with surfaces thereof having toner images formed thereon facing downward, are placed on the sheet tray 3.

The sheet conveyor unit 10 includes a sheet feed mechanism 11 and a sheet ejection mechanism 12. The sheet feed mechanism 11 is a mechanism that conveys sheets S on the sheet tray 3 one by one toward the transfer unit 50. The sheet feed mechanism 11 includes a pickup roller and a conveyor roller.

The sheet ejection mechanism 12 is a mechanism that ejects a sheet S which has passed through the transfer unit 50, to the outside of the housing 2. The sheet ejection mechanism 12 includes a plurality of conveyor rollers.

The film supply unit 30 is a unit that supplies and lays a multilayer film F onto a sheet S conveyed from the sheet feed mechanism 11. The film supply unit 30 includes a film unit FU, and a driving source 80 such as a motor. The driving source 80 is supported by the housing 2.

Figure 2:
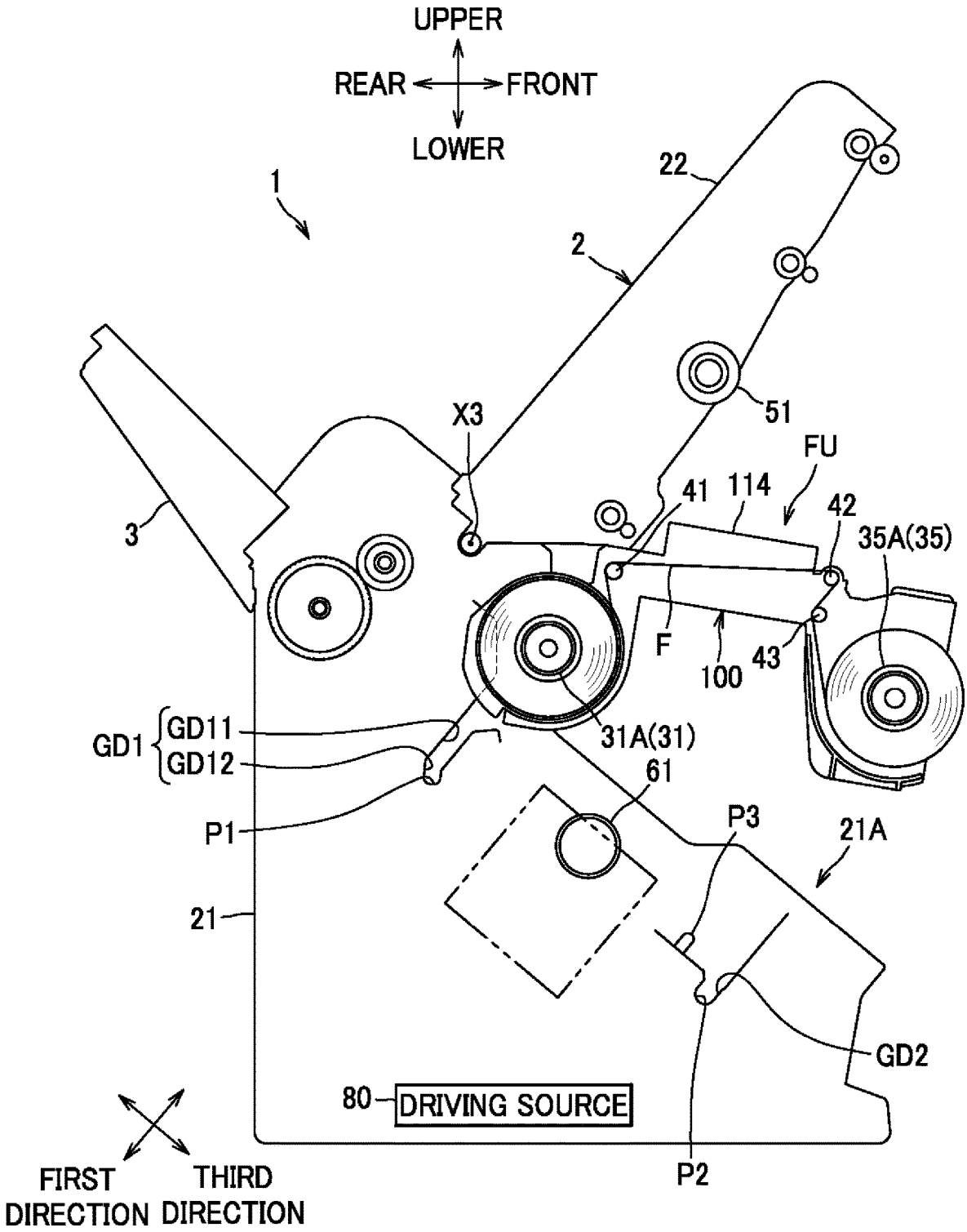
FIG. 2 is a diagram showing an open cover state of the layer transfer device.
Figure 4:
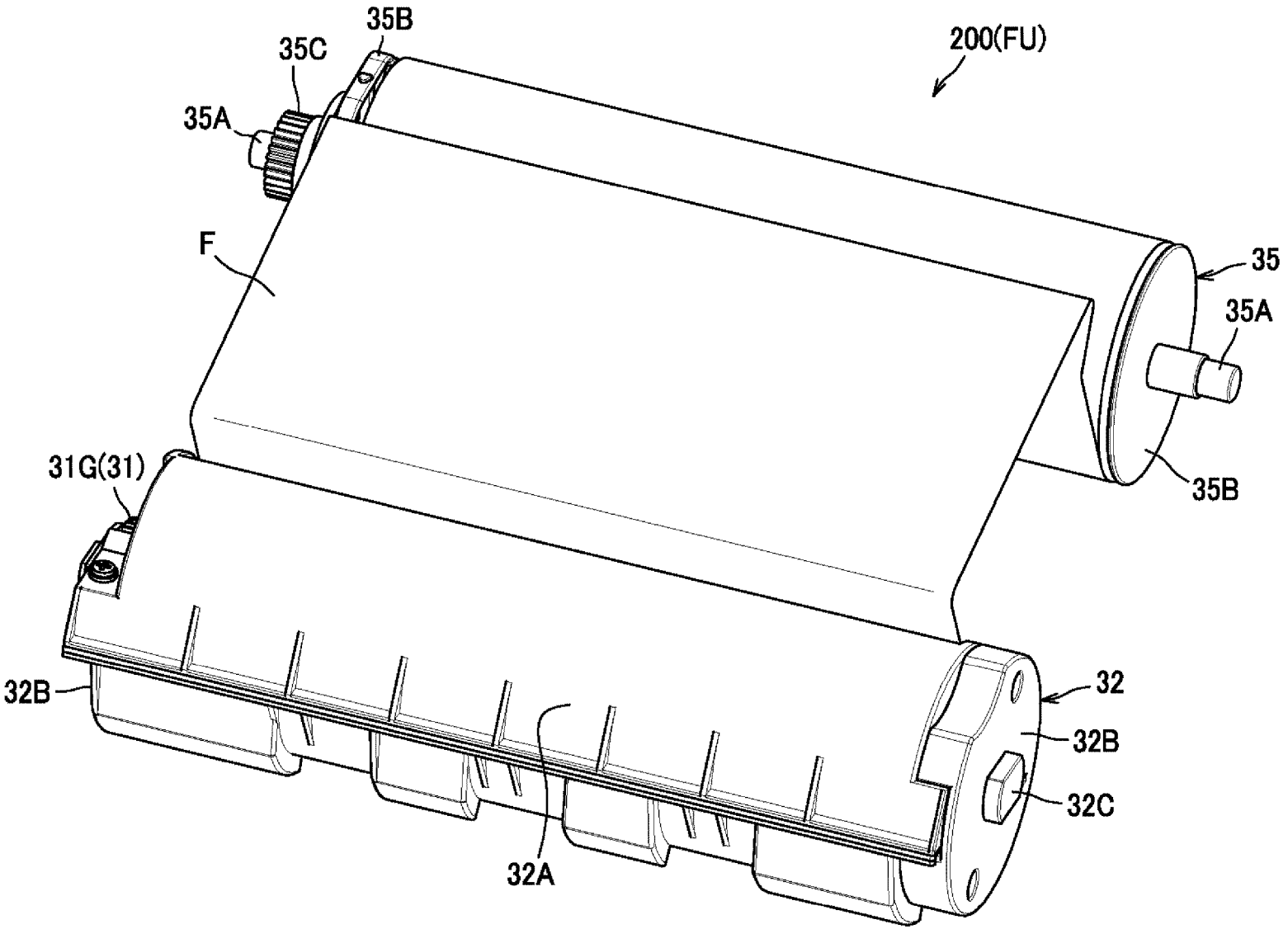
FIG. 4 is a perspective view showing a film cartridge.
Figure 5:
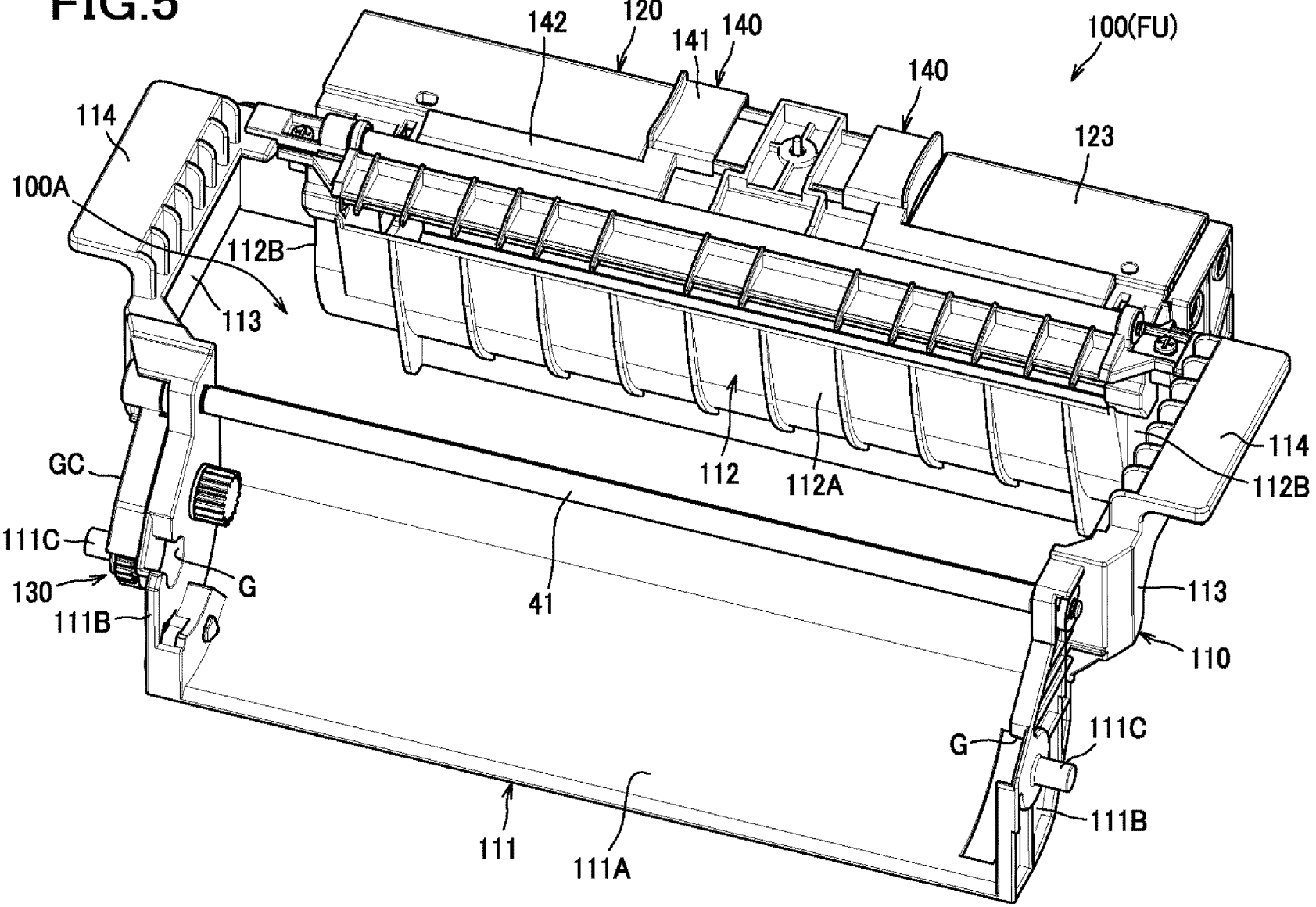
FIG. 5 is a perspective view showing a holder.

The film unit FU is configured, as shown in FIG. 2, to be installable into and removable from the housing main body 21 along a direction perpendicular to an axial direction of a supply reel 31 which will be described later. The film unit FU includes a supply reel 31, a take-up reel 35, a first guide shaft 41, a second guide shaft 42, and a third guide shaft 43. As shown in FIG. 4 and FIG. 5, the film unit FU includes: a holder 100 which will be described later and which includes the first guide shaft 41, the second guide shaft 42 and the third guide shaft 43; and a film cartridge 200 (which will be described later) which includes the supply reel 31 and the take-up reel 35 and which is installable into and removable from the holder. The holder 100 supporting the film cartridge 200 is installable into and removable from the housing main body 21 along a direction perpendicular to the axial direction of the supply reel 31. A multilayer film F is wound on the supply reel 31 and the take-up reel 35 of the film unit FU.

Figure 3:
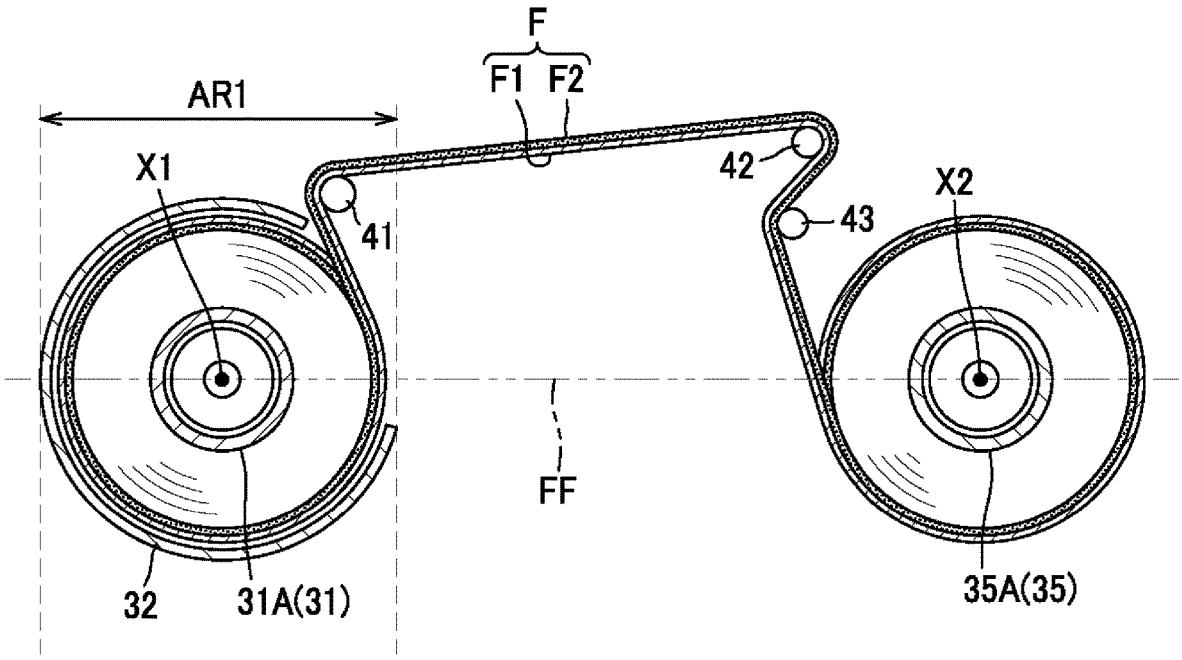
FIG. 3 includes: a section view (a) showing a relationship between a multilayer film and each shaft; and a section view (b) showing layers of the multilayer film in detail.
Figure 3:
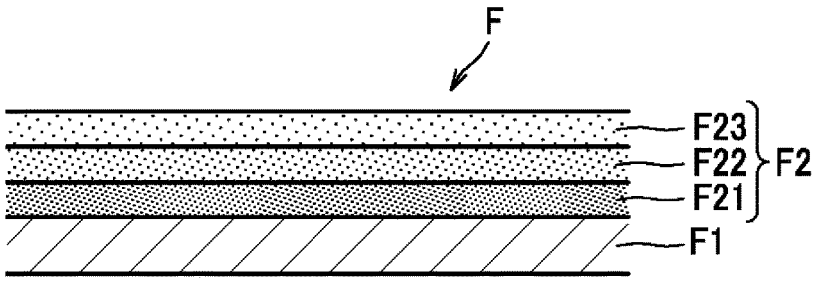

The multilayer film F is a film consisting of a plurality of layers. Specifically, as shown in FIG. 3(*a*), the multilayer film F includes a supporting layer F1 and a supported layer F2. The supporting layer F1 is a transparent substrate in the form of a tape and made of polymeric material, and supports the supported layer F2.

As shown in FIG. 3(*b*), the supported layer F2 includes a release layer F21, a transfer layer F22, and an adhesive layer F23. The release layer F21 is a layer for facilitating separation of the transfer layer F22 from the supporting layer F1, and is interposed between the supporting layer F1 and the transfer layer F22. The release layer F21 contains a transparent material, such as a wax-type resin, easily releasable from the supporting layer F1.

The transfer layer F22 is a layer to be transferred onto a toner image, and contains foil. Foil is a thin sheet of metal such as gold, silver, copper, aluminum, etc. The transfer layer F22 contains a colorant of gold-colored, silver-colored, red-colored, or other colored material, and a thermoplastic resin. The transfer layer F22 is interposed between the release layer F21 and the adhesive layer F23.

The adhesive layer F23 is a layer for facilitating adhesion of the transfer layer F22 to a toner image. The adhesive layer F23 contains a material, such as vinyl chloride resin, acrylic resin, etc., which tends to adhere to a toner image heated by the transfer unit 50 which will be described later.

The supply reel 31 is made of plastic or the like, and includes a supply shaft 31A on which a multilayer film F is wound. The multilayer film F is wound on the supply shaft 31A in such a manner that the supported layer F2 including the transfer layer F22 contacts the supply shaft 31A. That is, the multilayer film F is wound, with the supporting layer F1 facing outside and the supported layer F2 (transfer layer F22) facing inside, on the supply reel 31. Accordingly, in the outermost portion of a roll of the multilayer film F wound on the supply shaft 31A, the supporting layer F1 is positioned outside of the supported layer F2.

The take-up reel 35 is made of plastic or the like, and includes a take-up shaft 35A on which to take up the multilayer film F. The multilayer film F is to be wound on the take-up shaft 35A in such a manner that the supported layer F2 including the transfer layer F22 contacts the take-up shaft 35A. That is, the multilayer film F is to be wound, with the supporting layer F1 facing outside and the supported layer F2 (transfer layer F22) facing inside, on the take-up reel 35. Accordingly, in the outermost portion of a roll of the multilayer film F wound on the take-up shaft 35A, the supporting layer F1 is positioned outside of the supported layer F2.

It is to be understood that in FIG. 3 or other drawing figures, the supply reel 31 and the take-up reel 35 are illustrated as if the both reels were wound up to the maximum. In actuality, the film unit FU in new condition has its multilayer film F wound on the supply reel 31 in a roll of a maximum diameter, while no multilayer film F is wound on the take-up reel 35, or the multilayer film F is wound on the take-up reel 35 but in a roll of a minimum diameter. When the film unit FU is at the end of its life (i.e., the multilayer film F has been exhausted), the multilayer film F is to wound on the take-up reel 35 in a roll of a maximum diameter, while no multilayer film F is wound on the supply reel 31, or the multilayer film F is wound on the supply reel 31 but in a roll of a minimum diameter.

The first guide shaft 41 is a shaft for changing a traveling direction of the multilayer film F drawn out from the supply reel 31. The first guide shaft 41 is made of plastic or the like. The first guide shaft 41 contacts the supporting layer F1 of the multilayer film F. The first guide shaft 41 is located in a region AR1 (region between broken lines in the drawing) defined by causing a supply case 32, which will be described later, of the film cartridge 200 supported by the holder 100 to be projected in a perpendicular direction perpendicular to a plane FF containing the rotation axis X1 of the supply reel 32 and the rotation axis X2 of the take-up reel 35.

The second guide shaft 42 is a shaft for changing a traveling direction of the multilayer film F guided by the first guide shaft 41. The second guide shaft 42 is made of plastic or the like. The second guide shaft 42 contacts the supporting layer F1 of the multilayer film F. The second guide shaft 42 is located in a position farther, than the first guide shaft 41, from the supply reel 31 of the film cartridge 200 supported by the holder 100 in the perpendicular direction perpendicular to the plane FF containing the rotation axes X1, X2.

The third guide shaft 43 is a shaft for changing a traveling direction of the multilayer film F guided by the second guide shaft 42 toward the take-up reel 35. The third guide shaft 43 is made of plastic or the like. The third guide shaft 43 of the holder 100 supporting the film cartridge 200 is in contact with the supported layer F2 (adhesive layer F23) of the multilayer film F.

As shown in FIG. 1, the take-up reel 35 of the film unit FU installed in the layer transfer device 1 is caused to rotate counterclockwise as in the drawing by the driving source 80 provided in the housing 2. As the take-up reel 35 rotates, the multilayer film F wound on the supply reel 31 is drawn out, and the multilayer film F thus drawn out is taken up on the take-up reel 35. To be more specific, during the foil transfer process, the multilayer film F is forwarded by a pressure roller 51 and a heating roller 61 which will be described later whereby the multilayer film F is drawn out from the supply reel 31. The multilayer film F forwarded through the pressure roller 51 and the heating roller 61 are taken up on the take-up reel 35.

The first guide shaft 41 guides the multilayer film F drawn out from the supply reel 31 in such a manner that the supported layer F2 (see FIG. 3) thereof facing upward is laid under a sheet S being conveyed with a toner image facing downward. The first guide shaft 41 changes a direction of conveyance of the multilayer film F drawn out from the supply reel 31, and guides the multilayer film F in a direction substantially parallel to the direction of conveyance of the sheet S.

The second guide shaft 42 contacts the multilayer film F having passed through the transfer unit 50, and changes a direction of conveyance of the multilayer film F having passed through the transfer unit 50 into a direction different from a direction of conveyance of a sheet S. The multilayer film F having passed through the transfer unit 50 and conveyed with the sheet S laid thereon goes past the second guide shaft 42 and is thus guided in the direction different from the direction of conveyance of the sheet S, and peeled from the sheet S.

The transfer unit 50 is a unit that heats and pressurizes the sheet and the multilayer film F laid on each other, to transfer the transfer layer F22 onto a toner image formed on a sheet S. The transfer unit 50 includes a pressure roller 51 as an example of a pressure member, and a heating roller 61 as an example of a heating member. The transfer unit 50 applies heat and pressure to portions of a sheet S and a multilayer film F laid on each other and nipped between the pressure roller 51 and the heating roller 61.

The pressure roller 51 is a roller comprising a cylindrical metal core with its cylindrical surface coated with a rubber layer made of silicone rubber. The pressure roller 51 is located above the multilayer film F, and is contactable with a reverse side (opposite to a side on which a toner image is formed) of the sheet S.

The pressure roller 51 has two end portions supported rotatably by the cover 22. The pressure roller 51, which in combination with the heating roller 61, nips the sheet S and the multilayer film F, is driven to rotate by the driving source 80 and causes the heating roller 61 to rotate accordingly.

The heating roller 61 is a roller comprising a cylindrical metal tube with a heater located inside, to heat the multilayer film F and the sheet S. The heating roller 61 is located under the multilayer film F, and is in contact with the multilayer film F.

In this embodiment, the heating roller 61 is moved by a contact/separation mechanism 70 for bringing the heating roller 61 into and out of contact with the multilayer film F. When the cover 22 is closed, the contact/separation mechanism 70 causes the heating roller 61 to move to a contact position in which it contacts the multilayer film F, at each time when a sheet S is fed to the transfer unit 50. On the other hand, when the cover 22 is opened, or when foil transfer on a sheet S is not in process in the transfer unit 50, the contact/separation mechanism 70 causes the heating roller 61 to be positioned in a separate position in which it is separate from the multilayer film F.

With the layer transfer device 1 configured as described above, sheets S stacked on the sheet tray 3 with front surfaces facing downward are conveyed one by one toward the transfer unit 50 by the sheet feed mechanism 11. Each sheet S is laid on a multilayer film F supplied from the supply reel 31 at a position upstream of the transfer unit 50 in a sheet conveyance direction, and conveyed to the transfer unit 50 with a toner image of the sheet S being kept in contact with the multilayer film F.

In the transfer unit 50, the sheet S and the multilayer film F nipped and passing through between the pressure roller 51 and the heating roller 61 are heated and pressurized by the heating roller 61 and the pressure roller 51, so that foil is transferred onto the toner image, that is, the adhesive layer F23 of the multilayer film F is adhered to the toner image.

After foil is transferred, the sheet S and the multilayer film F adhered to each other are conveyed to the second guide shaft 42. When the sheet S and the multilayer film F travels past the second guide shaft 42, the direction of conveyance of the multilayer film F is changed into a direction different from the direction of conveyance of the sheet S; thereby the multilayer film F is peeled from the sheet S, that is, the supported layer F2 (including the adhesive layer F23 adhered to the toner image, the transfer layer F22 including foil, and the release layer F21) is peeled from the supporting layer F1 of the multilayer film F. It is to be understood that when the supported layer F2 is peeled from the supporting layer F1, part of the supported layer F2, specifically part of the release layer F21 may remain on the supporting layer F1.

The multilayer film F peeled from the sheet S and including a supporting layer F1 peeled from the supported layer F2 now adhered to the toner image on the sheet S is taken up on the take-up reel 35. On the other hand, the sheet S from which the multilayer film F is peeled has a foil transferred surface facing downward and is ejected to the outside of the housing 2 by the sheet ejection mechanism 12.

As shown in FIG. 2, the housing main body 21 includes a first locating portion P1, a second locating portion P2, a third locating portion P3 a first guide GD1, and a second guide GD2. The first locating portion P1 is a portion for locating the holder 100, which will be described later, of the film unit FU in place. To be more specific, as shown in FIG.

5, the holder 100 includes cylindrical bosses 111C, at opposite ends thereof apart from each other in the axial direction of the supply reel 31. Referring back to FIG. 2, the first locating portion P1 is formed as a groove having such a substantially semicircular shape as to conform to the outer cylindrical surface of each boss 111C. The first locating portion P1 includes a guiding terminal end of the first guide GD1. In other words, the first locating portion P1 is formed integrally with the guiding terminal end of the first guide GD1.

The second locating portion P2 is a portion for locating the take-up reel 35. To be more specific, as shown in FIG. 4, the take-up reel 35 includes a take-up shaft 35A extending along the rotation axis of the take-up reel 35. Both end portions of the take-up shaft 35A are each formed in a cylindrical shape. Referring back to FIG. 2, the second locating portion P2 is formed as a groove having such a substantially semicircular shape as to conform to the outer cylindrical surface of each end portion of the take-up shaft 35A, to locate the take-up shaft 35A in place relative to the housing 2. The second locating portion P2 includes a guiding terminal end of the second guide GD2. In other words, the second locating portion P2 is formed integrally with the guiding terminal end of the second guide GD2.

Figure 15:
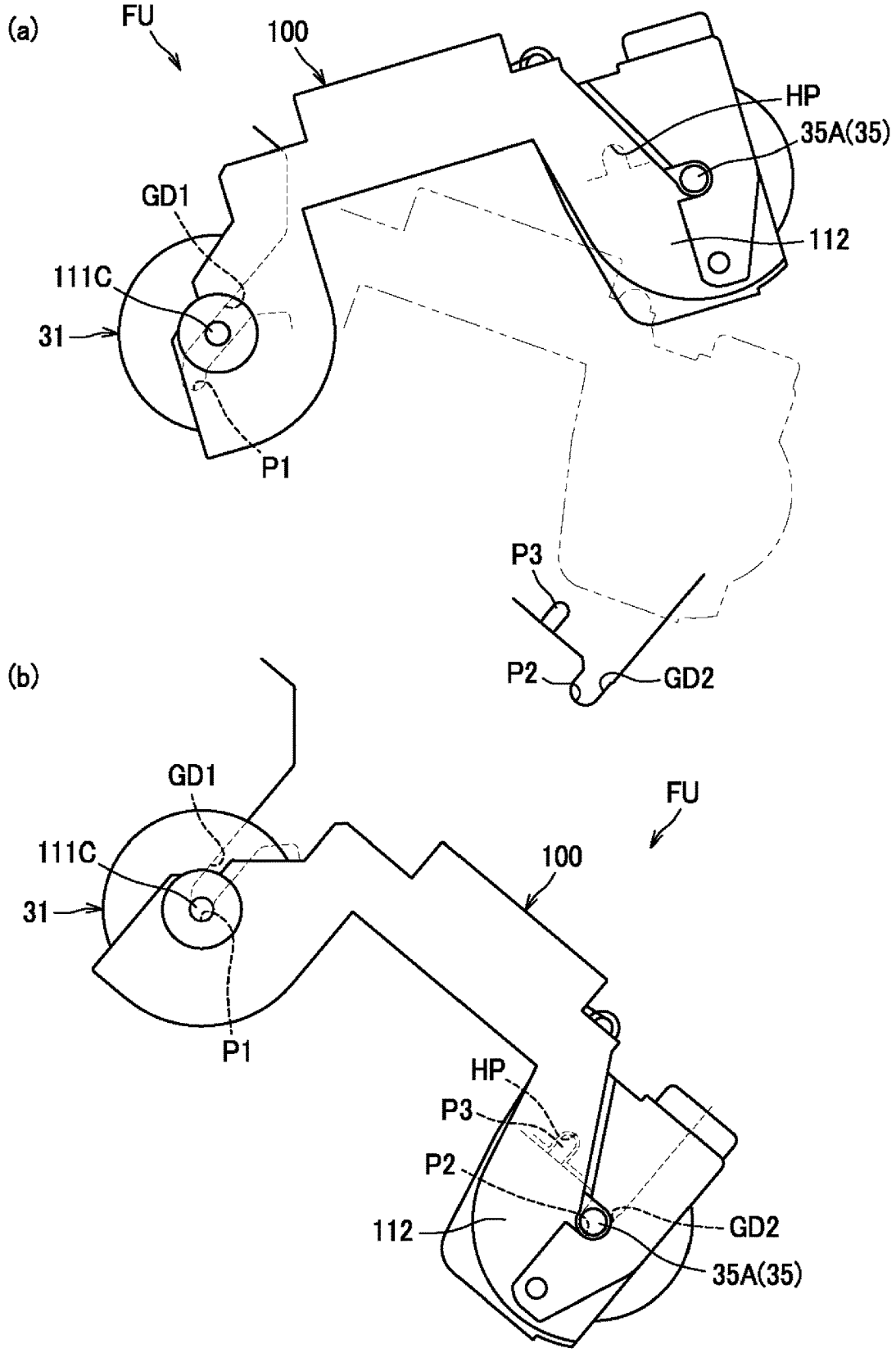
FIG. 15 includes diagrams (a), (b) showing an operation of installing the film unit into a housing main body.

The third locating portion P3 is a portion for locating the holder 100. To be more specific, as shown in FIG. 15(*a*), the holder 100 has a hole HP for locating. The hole HP is located closer to the take-up reel 35 than to the supply reel 31. To be more specific, the hole HP is formed in a second holding portion 112 of the holder 100 which will be described later.

Turning back to FIG. 2, the first guide GD1 is a guide which guides the holder 100 along a first direction perpendicular to the rotation axis of the supply reel 31 when the film unit FU is installed into and removed from the housing main body 21. In the present embodiment, the first direction refers to a direction perpendicular to the rotation axis of the supply reel 31 and slanted relative to the upward-downward direction and to the front-rear direction.

The second guide GD2 is a guide which guides the take-up shaft 35A of the take-up reel 35 along a second direction perpendicular to the rotation axis of the take-up reel 35 when the film unit FU is installed into and removed from the housing main body 21. In this embodiment, it is assumed that the second direction is the same direction as the first direction. It is to be understood that the second direction may be different to some extent from the first direction. The second guide GD2 is a groove extending along the first direction, and has an upper end opening toward the third opening 21A and a lower end connecting to the second locating portion P2.

The first guide GD1 is located closer than the second guide GD2 to the rotation axis X3 of the cover 22. The first guide GD1 includes a first portion GD11 and a second portion GD12. The first portion GD11 is a groove extending along the first direction, and has an upper end opening toward the third opening 21A.

The second portion GD12 is a groove connecting the first portion GD11 and the first locating portion P1, and extends from a lower end of the first portion GD11 downward. In other words, the second portion GD12 is slanted relative to the first direction.

The first locating portion P1 is located closer than the first portion GD11 to the second locating portion P2 in a third direction perpendicular to the first direction and the rotation axis X3. In other words, the distance from the first locating portion P1 to the second locating portion P2 as measured along the third direction is smaller than the distance from the first portion GD11 to the second locating portion P2.

As shown in FIG. 4 and FIG. 5, the film unit FU includes a holder 100 made of plastic or the like, and a film cartridge 200 installable into and removable from the holder 100. The film cartridge 200 includes a supply reel 31 and a take-up reel 35 on which a multilayer film F as described above is wound, and a supply case 32. The supply reel 31 (more specifically, the supply case 32) and the take-up reel 35 are installable into and removable from the holder 100 in directions perpendicular to the axial direction of the supply reel 31. In other words, the film cartridge 200 is installable into and removable from the holder 100 in directions perpendicular to the axial direction of the supply reel 31. The holder 100 with the film cartridge 200 installed therein can be installed into and removed from the housing main body 21 while supporting the film cartridge 200.

The supply case 32 is a hollow case accommodating the supply reel 31. The supply case 32 is made of plastic or the like, and includes an outer peripheral wall 32A having a substantially cylindrical surface, and two side walls 32B each having a shape of a substantially circular disc and provided at both ends of the outer peripheral wall 32A. The supply reel 31 is rotatably supported by the respective side walls 32B of the supply case 32.

Each of the side walls 32B includes an engageable portion 32C having an elongate shape as viewed from a direction along the axis of the supply reel 31. Each engageable portion 32C is a portion to be guided by an installation/removal guide G of the holder 100 which will be described later, and is formed in a shape of a rounded corner rectangle.

The supply reel 31 includes a supply gear 31G at an end of the supply shaft 31A facing outward in a direction along the axial direction of the supply reel 31. The supply gear 31G is a gear that rotates together with the supply reel 31 about the rotation axis of the supply reel 31. In other words, the supply gear 31G rotates together with the supply shaft 31A. The supply gear 31G is exposed to outside through a cutaway opening formed in the outer peripheral wall 32A.

Figure 6:
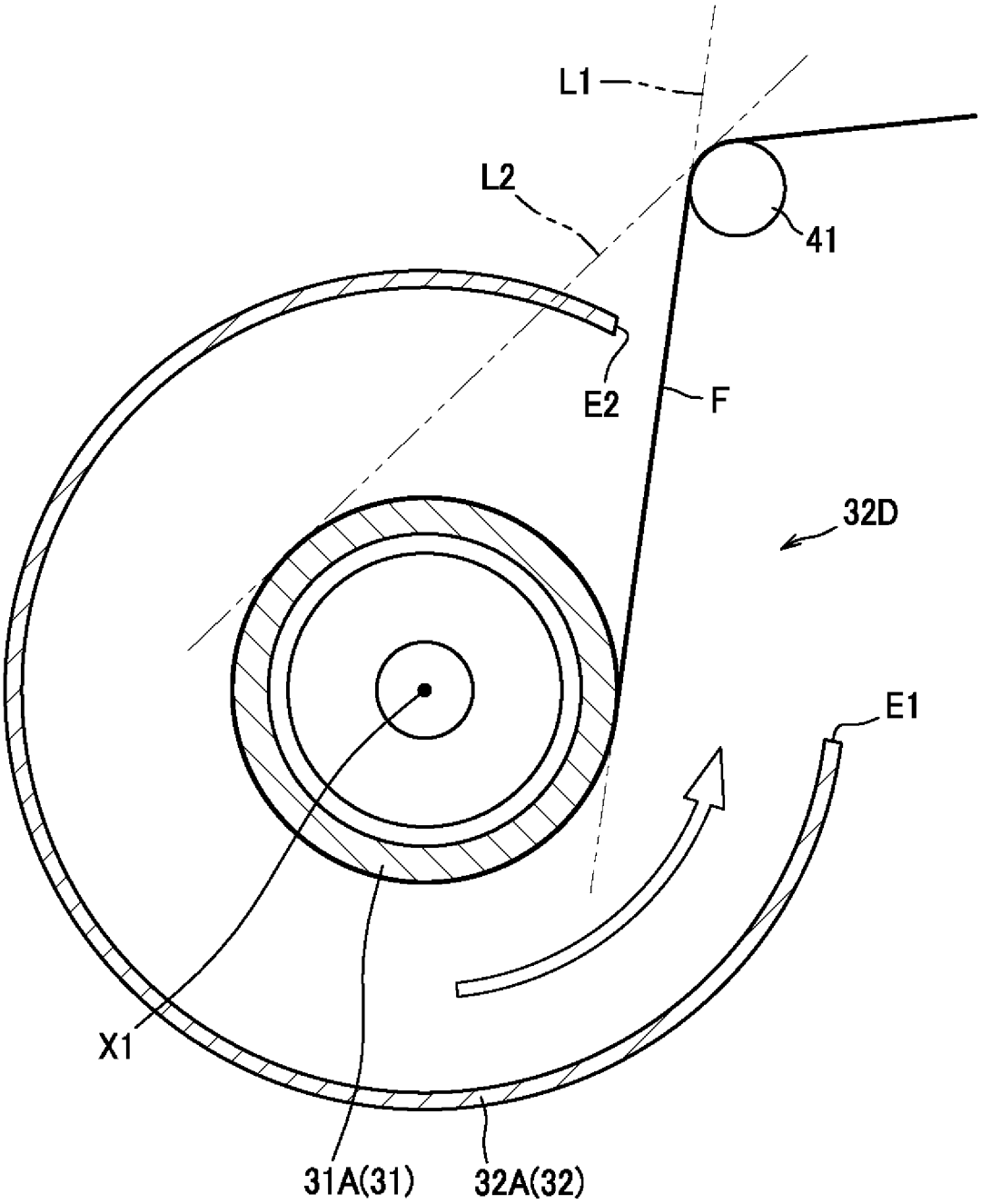
FIG. 6 is a section view showing a structure of a first opening and its vicinity of a supply case.

As shown in FIG. 6, the outer peripheral wall 32A has a first opening 32D. The first opening 32D is an opening for allowing the multilayer film F on the supply reel 31 to be drawn out. The first opening 32D has an upstream end E1 and a downstream end E2 located downstream from the upstream end E1 in the direction of rotation of the supply reel 31.

Figure 12:
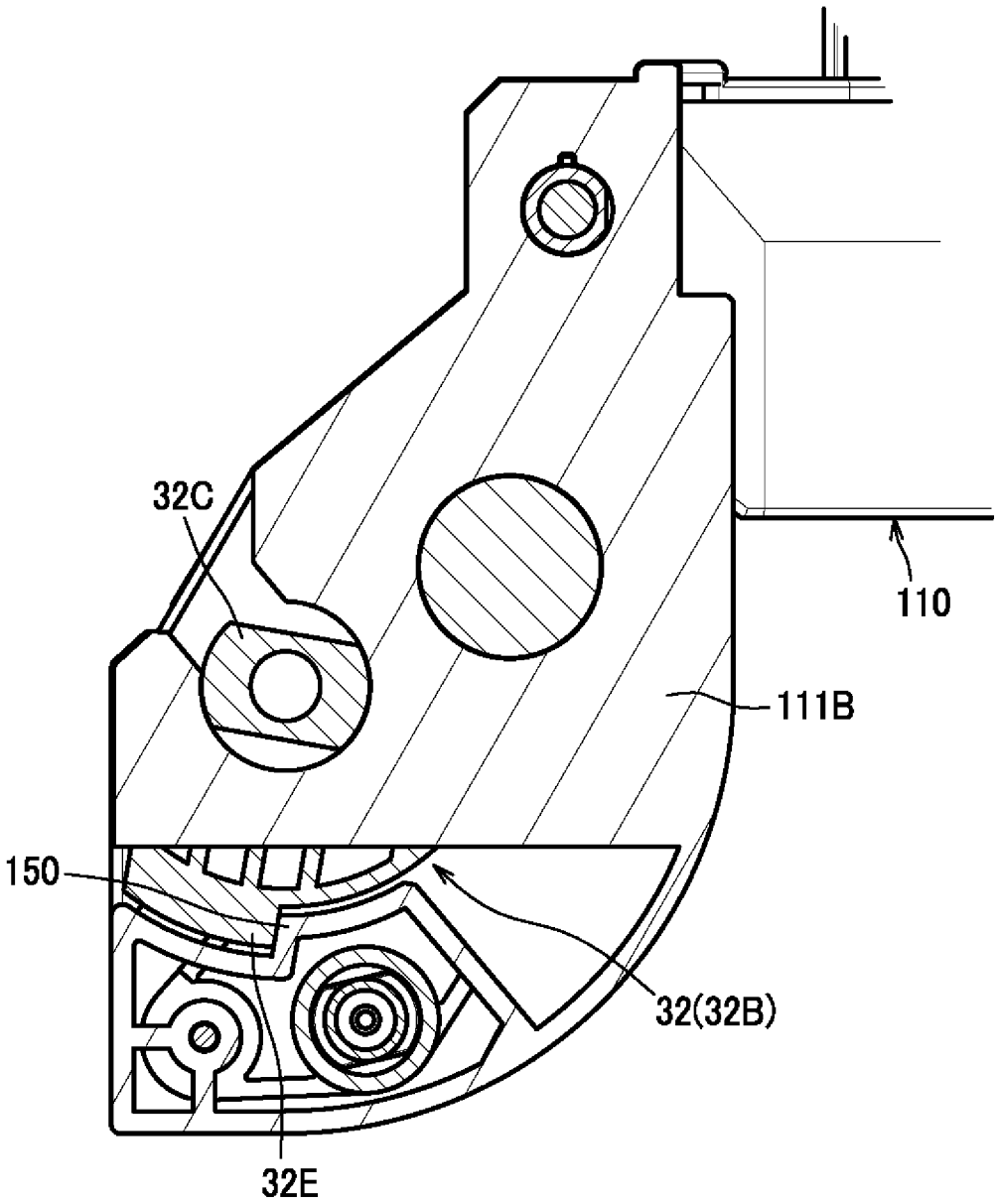
FIG. 12 is a section view taken along the line I-I of FIG. 11.

When the film cartridge 200 is installed in the holder 100, the downstream end E2 is located between the multilayer film F positioned along an internal common tangent L1 of the first guide shaft 41 and the supply shaft 31A and an external common tangent L2 of the first guide shaft 41 and the supply shaft 31A. Herein, the state when the film cartridge 200 is installed in the holder 100 is understood to indicate the state to be assumed when the rotation of the supply case 32 is restrained by a restraining portion 150 (see FIG. 12) which will be described later. The external common tangent L2 of the first guide shaft 41 and the supply shaft 31A is one located farther than the other from the take-up reel 35 of two external common tangents of which one is farther from and the other is closer to the take-up reel 35. The multilayer film F positioned along the internal common tangent L1 refers to the multilayer film F stretched between the first guide shaft 41 and the supply shaft 31A when the multilayer film F wound on the supply reel 31 has been drawn out to the last.

Returning to FIG. 4, the take-up reel 35 includes, in addition to the take-up shaft 35A described above, two flanges 35B, and a take-up gear 35C as an example of a driving power transmission member or a driving power input member. End portions of the take-up shaft 35A pointing outward in directions along the axial direction of the take-up reel 35 are portions each guided by the second guide GD2 (see FIG. 2) formed in the housing main body 21, and protrude farther outward from the flanges 35B.

The flanges 35B are portions for restraining widthwise movement of the multilayer film F wound on the take-up shaft 35A. The flanges 35B are each formed in a shape of a disc having a diameter larger than that of the take-up shaft 35A, and provided at both end portions of the take-up shaft 35A.

Figure 13:
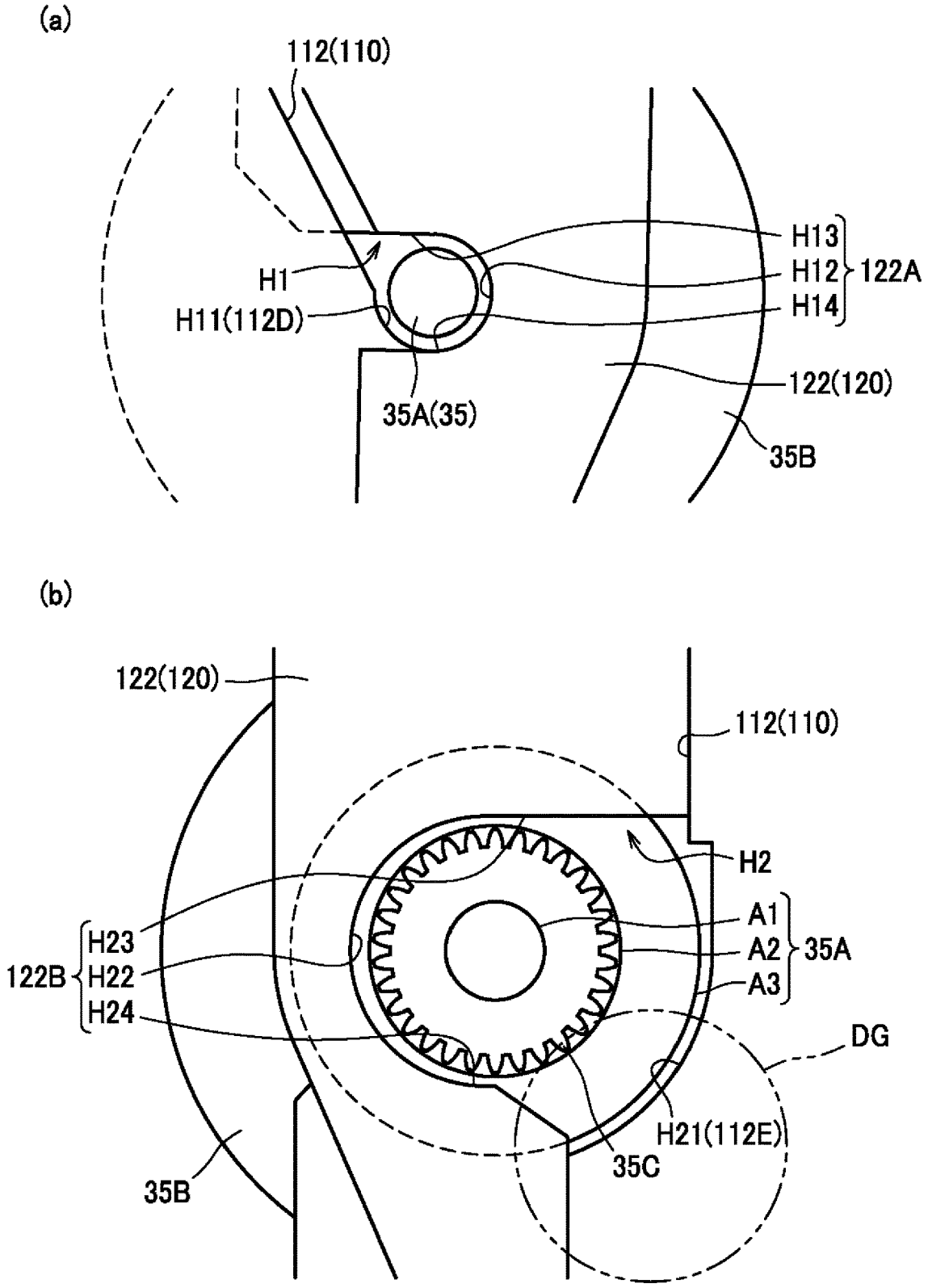
FIG. 13 shows portions of a take-up reel, and includes: a diagram (a) showing a structure of one end portion and its vicinity; and a diagram (b) showing a structure of the other end portion and its vicinity.

The take-up gear 35C is a gear which obtains a driving power from the driving source 80 provided in the layer transfer device 1, serving to receive the driving power and transmit the driving power to the take-up shaft 35A. The take-up gear 35C is located on an outside of the flange 35B facing in a direction along the axial direction. The take-up gear 35C is located on the rotation axis of the take-up reel 35, specifically, coaxially with take-up shaft 35A. To be more specific, as shown in FIG. 13, the take-up gear 35C is engageable with a driving gear DG rotatably supported by the housing 2. Accordingly, the driving power of the driving source 80 is transmitted through the driving gear DG to the take-up gear 35C.

As shown in FIG. 2 and FIG. 5, the holder 100 includes a first guide shaft 41, a second guide shaft 42, a third guide shaft 43, a base frame 110, and a restraining frame 120 rotatably (movably) supported by the base frame 110. The base frame 110 includes a first holding portion 111, a second holding portion 112, two connecting portions 113 and two handles 114.

The first holding portion 111 is a portion that holds the supply case 32. The first holding portion 111 holds (or supports) the supply reel 31 via the supply case 32. The first holding portion 111 includes an outer peripheral wall 111A having a substantially arcuate shape in cross section, and two side walls 111B.

The outer peripheral wall 111A is located along the outer peripheral surface of the supply case 32. The side wall 111B is located at each end of the outer peripheral wall 111A facing outward in the axial direction of the supply reel 31.

The side walls 111B are arranged outside in directions along the axial direction of the first guide shaft 41 with the first guide shaft 41 held therebetween, and support the first guide shaft 41 in a manner that permits the first guide shaft 41 to rotate. Each of the side walls 111B has an installation/removal guide G for guiding the supply case 32 along a predetermined direction when the supply case 32 is installed and removed. The installation/removal guide G is formed in an inner surface facing inward in a direction along the axial direction (inner surface facing the supply case 32 in a direction along the axial direction) of each side wall 111B.

Figure 7:
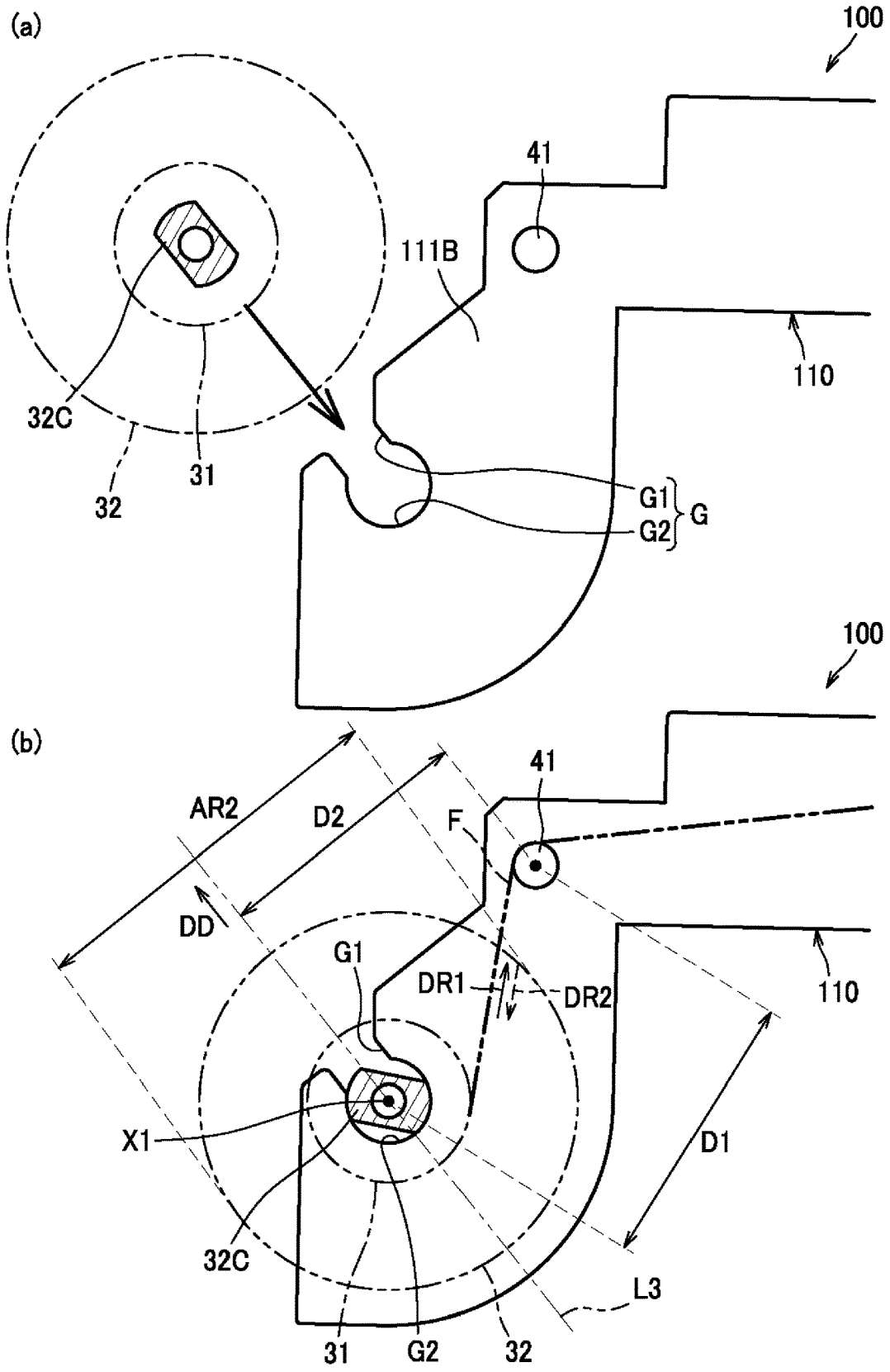
FIG. 7 includes section views (a), (b) showing a relationship between an engageable portion and an installation/removal guide.

As shown in FIG. 7(*a*), (*b*), the installation/removal guide G includes a guide groove G1 extending in a predetermined direction, and a holding hole G2 in a circular shape. The guide groove G1 is a groove that guides the engageable portion 32C along the predetermined direction (the direction indicated by an arrow in the drawing). The width (the dimension perpendicular to the predetermined direction) of the guide groove G1 is smaller than the longer side of the engageable portion 32C and greater than the shorter side of the engageable portion 32C.

The predetermined direction along which the engageable portion 32C is guided by the guide groove G1 is defined as follows. As shown in FIG. 7(*b*), the predetermined direction is set such that a direction DD of movement of the supply case 32 guided by the guide groove G1 when the supply case 32 is removed from the holder 100, that is, a direction of removal, is a direction of a vector which does not contain a component of a vector a direction DR2 of which is opposite to a direction DR1 in which the multilayer film F is drawn out from the supply reel 31. The "direction DR1 in which the multilayer film F is drawn out from the supply reel 31" which may vary according to a roll diameter of the multilayer film F wound on the supply reel 31 is to be understood to refer to a direction assumed when the multilayer film F wound on the supply reel 31 has been drawn out to the last.

In this embodiment, the guide groove G1 is configured to guide the engageable portion 32C of the supply case 32 such that when the supply case 32 is removed from the holder 100 along the predetermined direction, an inter-axial distance between the supply reel 31 and the first guide shaft 41 decreases gradually. To be more specific, the predetermined direction is set such that when the supply reel 31 is installed in the holder 100, a distance D2 between a straight line L3 passing through the rotation axis X1 of the supply reel 31 and extending along the predetermined direction, and a center of the first guide shaft 41 is smaller than an inter-axial distance D1 between the supply reel 31 and the first guide shaft 41.

The first guide shaft 41 is located out of a region AR2 (region between broken lines in the drawing) defined by causing the supply case 32 installed in the holder 100 to be projected in the predetermined direction.

The holding hole G2 is a circular hole configured to hold the engageable portion 32C in a manner that permits the engageable portion 32C to rotate, and is connected to the guide groove G1. The holding hole G2 has a diameter greater than the longer side of the engageable portion 32C. When the engageable portion 32C is inserted in the guide groove G1 and put into the holding hole G2, and the supply case 32 is thereafter caused to rotate counterclockwise as in the drawing, the supply case 32 is brought into contact with the restraining portion 150 shown in FIG. 12 and located in place, with the result that the supply case 32 is installed in the holder 100.

The restraining portion 150 is a portion that restrains rotation of the supply case 32 with the engageable portion 32C held in the holding hole G2. The restraining portion 150 is provided in one of the side walls 111B of the holder 100. The supply case 32 includes a contact portion 32E contactable with the restraining portion 150. The contact portion 32E is provided in one of the side walls 32B (the side wall 32 on which the supply gear 31G is located) of the supply case 32.

The restraining portion 150 and the contact portion 32E are arranged such that a longitudinal direction of the engageable portion 32C of the supply case 32 of which rotation is restrained by the restraining portion 150 is nonparallel to the predetermined direction. In other words, the longitudinal direction of the engageable portion 32C of the supply case 32 of which rotation is restrained by the restraining portion 150 intersects with the straight line L3 oriented along the predetermined direction parallel to the direction DD of movement shown in FIG. 7(*b*).

Referring back to FIG. 5, a gearing system 130 is provided at one of the two side walls 111B. The gearing system 130 is a mechanism for imposing on the supply reel 31 a load of a torque limiter (not shown) provided in the housing main body 21. The structure of the gearing system 130 will be described later.

Each side wall 111B includes a boss 111C having a shape of a circular cylinder. To be more specific, the side wall 111B on which the gearing system 130 is provided includes a boss 111C via a gear cover GC. The gear cover GC is a cover with which the gearing system 130 is covered, and includes the boss 111C. The gear cover GC is fixed on a surface of the side wall 111B facing outward in a direction along the axial direction.

Each boss 111C is a portion to be guided by the first guide GD1 (see FIG. 2) formed in the housing main body 21 when the film unit FU is installed into and removed from the housing main body 21. One of the bosses 111C protrudes from a surface of the side wall 111B facing outward in a direction along the axial direction. The other of the bosses 111C protrudes from a surface of the gear cover GC facing outward in another direction along the axial direction.

Each boss has a shape of a circular cylinder, and is located coaxially. With this feature, as shown in FIG. 15(*b*), when the bosses 111C are being guided by the first guides GD1, the holder 100 is rendered rotatable about the bosses 111C.

Referring back to FIG. 5, the second holding portion 112 is a portion that holds (supports) the take-up reel 35. To be more specific, the second holding portion 112 is combined with the restraining frame 120 to make up a hollow case, and the take-up reel 35 is accommodated in the hollow case.

The second holding portion 112 includes a covering portion 112A and two side walls 112B. The covering portion 112A is a portion that covers the multilayer film F wound on the take-up reel 35. The side wall 112B is located at each end of the covering portion 112A facing outward in the axial direction of the take-up reel 35.

The two connecting portions 113 are portions that connect the first holding portion 111 and the second holding portion 112. To be more specific, the connecting portions 113 are arranged apart from each other in the axial direction of the supply reel 31. One of the connecting portions 113 apart from each other in the axial direction connects one of the side walls 111B of the first holding portion 111 and one of the side walls 112B of the second holding portion 112. The other of the connecting portions 113 apart from each other in the axial direction connects the other of the side walls 111B of the first holding portion 111 and the other of the side walls 112B of the second holding portion 112.

With the connecting portions 113 being formed in this way, the holder 100 is provided with a through hole 100A extending in a perpendicular direction perpendicular to the axial direction of the supply reel 31. The handle 114 is provided on each of the connecting portions 113. The handles 114 are located at opposite ends of the holder 100 apart from each other in the axial direction of the take-up reel 35 of the film cartridge 200 supported by the holder 100.

Figure 8:
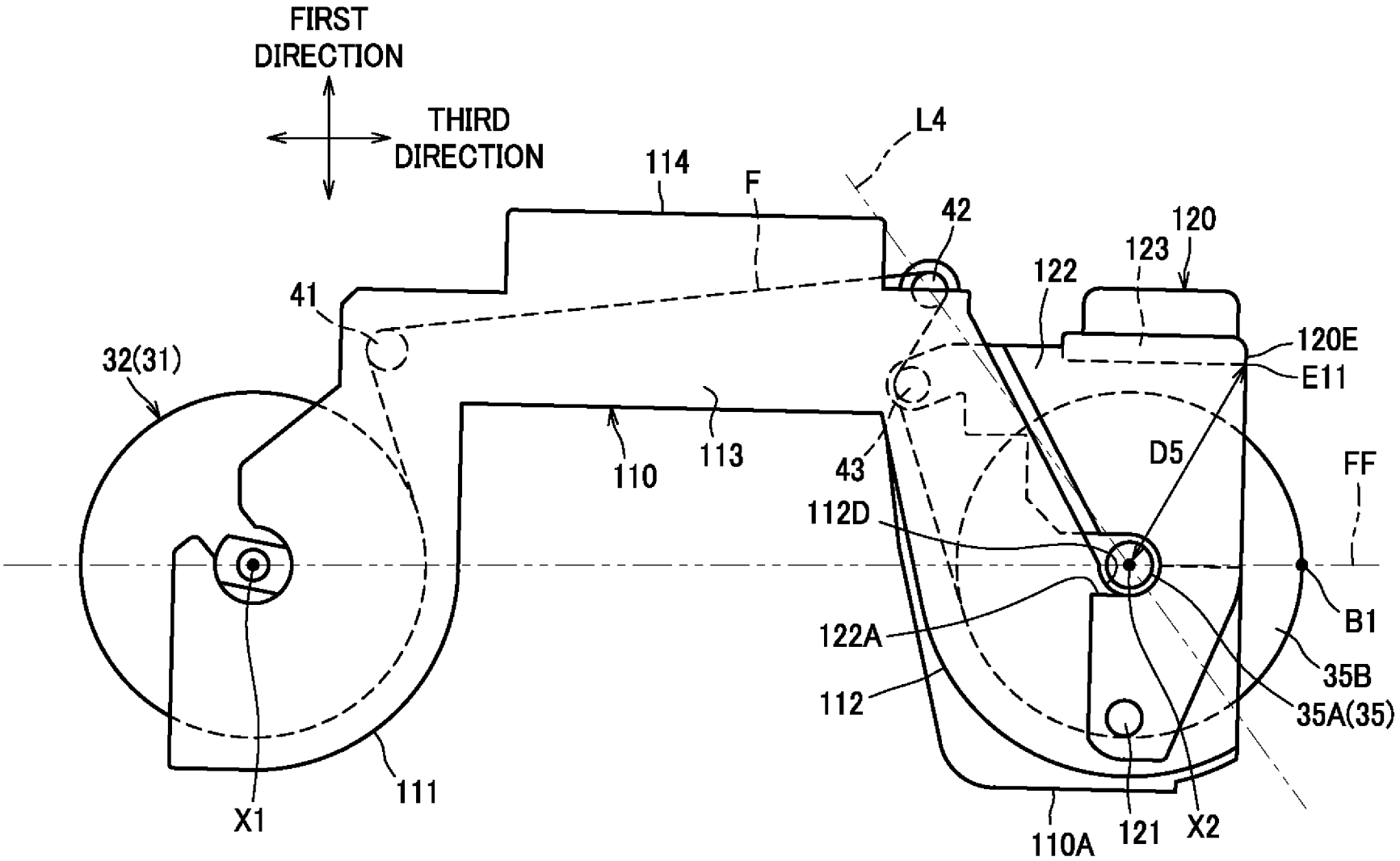
FIG. 8 is a side view of the film unit as viewed from a direction along an axial direction.

As shown in FIG. 8, the connecting portions 113 are located off a plane FF containing the rotation axis X1 of the supply reel 31 held by the first holding portion 111 and the rotation axis X2 of the take-up reel 35 held by the second holding portion 112, to one side (on the upper side of the plane FF in the drawing). Each of the handles 114 protrudes in a position shifted from the multilayer film F laid on the first guide shaft 41 and the second guide shaft 42 of the holder 100 supporting the film cartridge F, in a direction away from the first guide shaft 41 and the second guide shaft 42 (the position on the upper side of the film F in the drawing).

When the holder 100 is supporting the film cartridge 200, the outer surface of the base frame 110 has a first surface 110A located in a position shifted in the perpendicular direction perpendicular to the plane FF containing the rotation axis X1 of the supply reel 31 and the rotation axis X2 of the take-up reel 35, on one side relative to the third guide shaft 43 which is the same side as that on which the rotation axis X2 of the take-up reel 35 is located. The first surface 110A is located in the position distanced farther than the rotation axis X2 of the take-up reel 35 from the third guide shaft 43.

Figure 9:
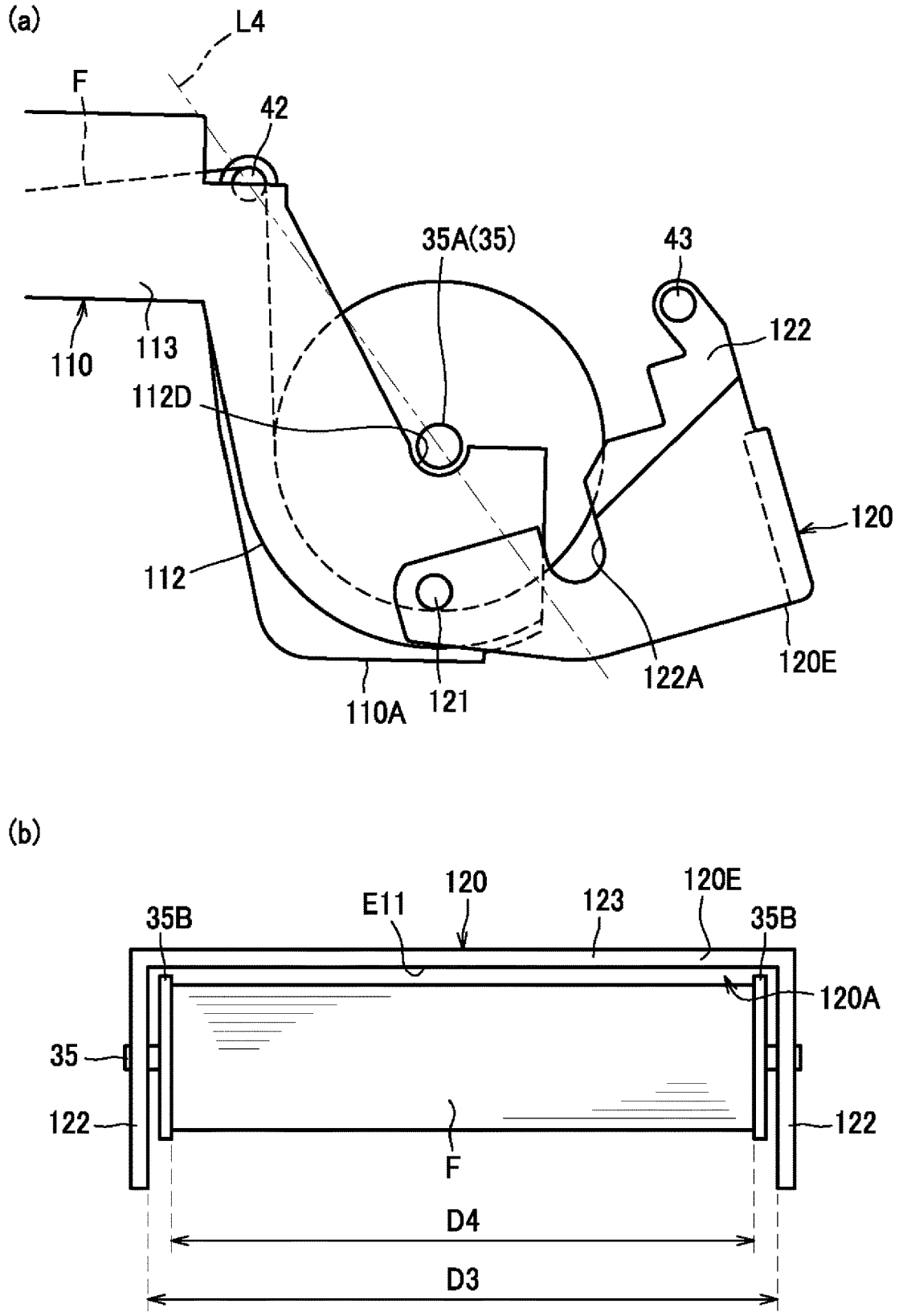
FIG. 9 includes: a section view (a) showing a state of a restraining frame moved to a release position; and a diagram (b) showing the restraining frame located in a restraining position as viewed from a second opening side.

The restraining frame 120 is configured to be rotatable between a restraining position shown in FIG. 8 and a release position shown in FIG. 9(*a*). When the restraining frame 120 of the holder 100 supporting the film cartridge 200 is in the restraining position, restraint is placed on movement of the take-up reel 35 in installation/removal directions thereof. When the restraining frame 120 of the holder 100 supporting the film cartridge 200 is in the release position, the restraint on the movement of the take-up reel 35 is lifted.

The restraining frame 120 includes the third guide shaft 43. When the restraining frame 120 is in the restraining position, the third guide shaft 43 is positioned in a first position; when the restraining frame 120 is in the release position, the third guide shaft 43 is positioned in a second position.

When the holder 100 is supporting the film cartridge 200, the third guide shaft 43 in the first position is positioned closer to the supply reel 31 than, that is on a supply reel side with respect to, a straight line L4 connecting a center of the take-up shaft 35A (rotation axis X2 of the take-up reel 35) and a center of the second guide shaft 42. When the holder 100 is supporting the film cartridge 200, the third guide shaft 43 in the second position is positioned on a side opposite to the supply reel side (the side on which the supply reel 31 is positioned) with respect to the straight line L4. When the holder 100 is supporting the film cartridge 200, the third guide shaft 43 in the second position is far apart from the second guide shaft 42 at a distance greater than a maximum roll diameter of the multilayer film F wound on the take-up reel 35. In other words, the axial distance between the second guide shaft 42 and the third guide shaft 43 in the second position is greater than the maximum roll diameter of the multilayer film F wound on the take-up reel 35.

The restraining frame 120 in the restraining position has one end 120E that is located farthest from the supply reel 31 supported by the holder 100. To be more specific, the one end 120E is in a position distanced farthest from the supply reel 31 along a direction parallel to the straight line connecting the rotation axis X1 of the supply reel 31 and the rotation axis X2 of the take-up reel 35. As shown in FIG. 9(*b*), the one end 120E has a second opening 120A through which the multilayer film F wound on the take-up reel 35 is exposed to outside when the restraining frame 120 is in the restraining position. In other words, the one end 120E comprises the second opening 120A through which the take-up reel 35 supported by the holder 100 is exposed to outside.

The second opening 120A has a dimension D3 in the axial direction which is wider than the width D4 of the multilayer film F. As shown in FIG. 8, the second opening 120A has edges among which an edge E11 oppositely laid across an outer surface of the multilayer film F is positioned such that a distance D5 therefrom to the rotation axis X2 of the take-up reel 35 supported by the holder 100 is greater than a maximum roll radius of the multilayer film F wound on the take-up reel 35.

The restraining frame 120 is configured to be rotatable relative to the base frame 110 about the rotation axis 121. When the holder 100 is supporting the film cartridge 200, the rotation axis 121 is in a position distanced farther than the rotation axis X2 of the take-up reel 35 from the third guide shaft 43 in the perpendicular direction perpendicular to the plane FF mentioned above.

The take-up reel 35 comprises a farthest portion B1 that is located farthest from the supply reel 31 when the holder 100 is supporting the film cartridge 200. In this embodiment, it is the flange 35B of the take-up reel 35 that comprises the farthest portion B1. The farthest portion B1 is distanced farthest from the supply reel 31 in a direction along the straight line connecting the rotation axis X1 of the supply reel 31 and the rotation axis X2 of the take-up reel 35.

When the holder 100 is supporting the film cartridge 200, the one end 120E of the restraining frame 120 in the restraining position is closer than the farthest portion B1 to the supply reel 31. To be more specific, the one end 120E is closer than the farthest portion B1 to the supply reel 31 in the direction along the straight line connecting the rotation axis X1 of the supply reel 31 and the rotation axis X2 of the take-up reel 35.

More specifically, as shown in FIG. 9(*b*), the restraining frame 120 includes two side walls 122 and a connecting wall 123 connecting the side walls 122. As shown in FIG. 8, the respective side walls 122 are rotatably supported by the base frame 110. The side walls 122 are supporting the third guide shaft 43 in a manner that renders the third guide shaft 43 rotatable. The respective side walls 122 have recesses 122A, 122B (see FIG. 13(*b*)) formed therein in which take-up shaft 35A of the take-up reel 35 is placed.

As shown in FIG. 13(*a*), the recess 122A in combination with a recess 112D formed in the second holding portion 112 forms a hole H1 that holds the take-up shaft 35A. This hole H1 is a hole in which the take-up shaft 35A is engageable with clearance allowed therebetween. The take-up shaft 35A is configured to be movable inside the hole H1 in directions perpendicular to the axial direction.

The take-up reel 35 comprises the farthest portion B1 that is located farthest from the supply reel 31. In the present embodiment, it is the flange 35B of the take-up reel 35 that comprises the farthest portion B1. The farthest portion B1 is distanced farthest from the supply reel 31 in a direction along the straight line connecting the rotation axis X1 of the supply reel 31 and the rotation axis X2 of the take-up reel 35.

When the restraining frame 120 is in the restraining position, the one end 120E of the restraining frame 120 is closer than the farthest portion B1 to the supply reel 31. To be more specific, the one end 120E is closer than the farthest portion B1 to the supply reel 31 in the direction along the straight line connecting the rotation axis X1 of the supply reel 31 and the rotation axis X2 of the take-up reel 35.

As shown in FIG. 5, two lock members 140 are provided on the restraining frame 120. The lock members 140 are supported, movably along the axial direction, by the connecting wall 123 of the restraining frame 120. The lock members 140 are biased in directions away from each other by a spring (not shown).

Each lock member 140 includes an operation part 141 and an extension part 142. The operation part 141 is a part to be operated by a user. The operation parts 141 are located in the middle of a range, along the axial direction, of the connecting wall 123 of the restraining frame 120.

Figure 10:
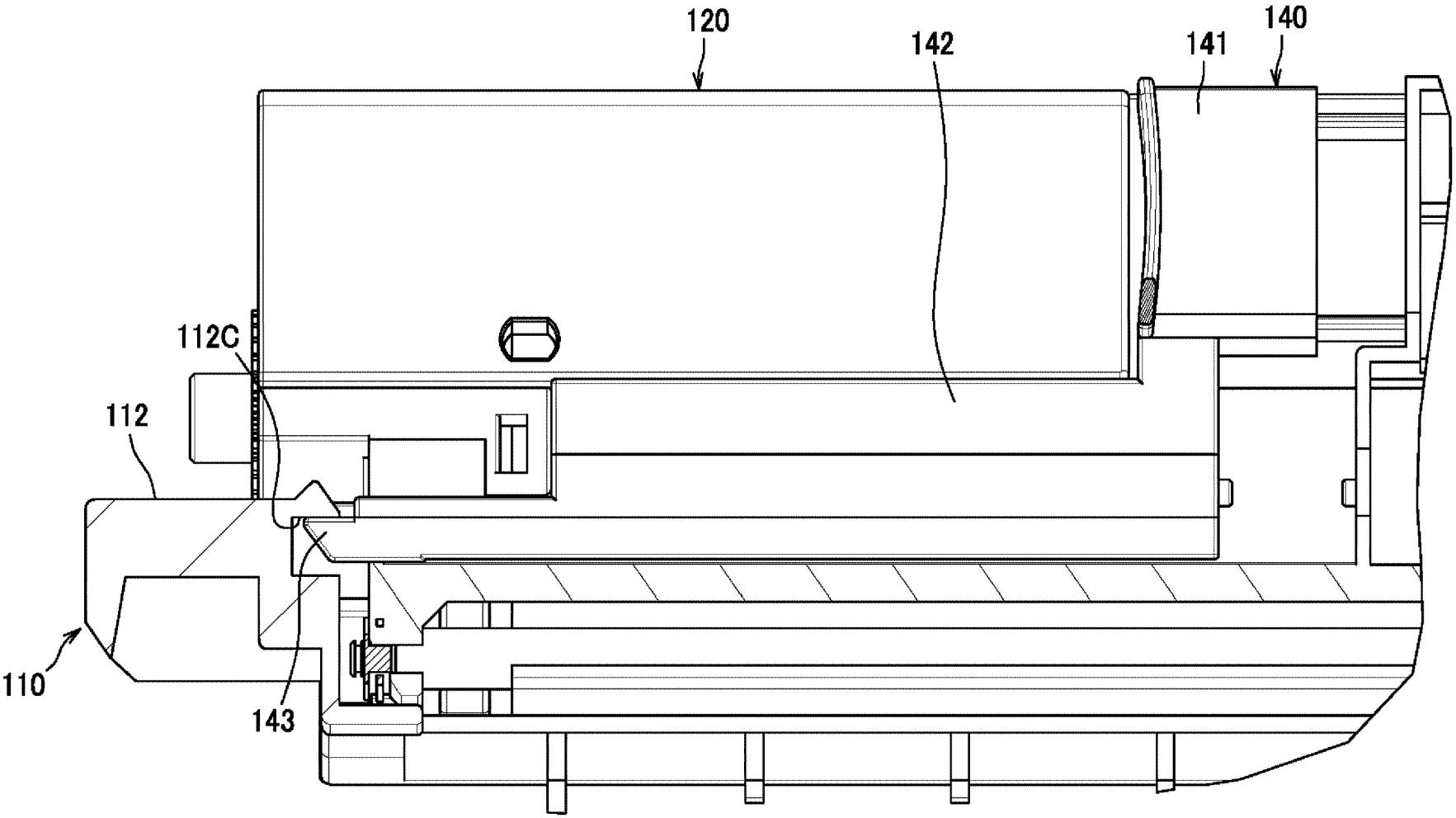
FIG. 10 is a section view showing a relationship between a lock member and a base frame.

The extension part 142 extends from the operation part 141 outward along the axial direction. As shown in FIG. 10, the extension part 142 has an extreme end 143 engaged with a recess 112C formed in the second holding portion 112 of the base frame 110. Such engagement of the extreme end 143 with the recess 112C serves to restrain the restraining frame 120 from moving from the restraining position to the release position.

The extreme end 143 is biased toward the recess 112C by the spring (not shown) and thereby engaged in the recess 112C unless the operation part 141 is operated. The extreme end 143 is configured to get disengaged from the recess 112 when the operation part 141 is moved against the biasing force of the spring.

As shown in FIG. 8, when the restraining frame 120 is in the restraining position, the third guide shaft 43 receives a biasing force from the multilayer film F. To be more specific, when the restraining frame 120 is in the restraining position and the take-up reel 35 is driven, a tension is produced on the multilayer film F between the second guide shaft 42 and the take-up shaft 35A, and causes the multilayer film F to tend to orient into a straight position between the second guide shaft 42 and the take-up shaft 35A.

Accordingly, the third guide shaft 43, and by extension the restraining frame 120, receives the biasing force from the multilayer film F, and is biased toward a direction from the restraining position to the release position.

Therefore, as shown in FIG. 10, when the holder 100 is supporting the film cartridge 200, the extreme end 143 of the lock member 140 as well is biased by a biasing force applied on the third guide shaft 43 from the multilayer film F, toward a side surface of the recess 112C of the base frame 110. In other words, the extreme end 143 of the lock member 140 receives the biasing force from the multilayer film F, and is biased from the restraining position to the release position, and brought into contact with the side surface of the recess 112C.

The recess 112D formed in the base frame 110 has a first restraining surface H11. The recess 122A formed in the restraining frame 120 has a second restraining surface H12, a third restraining surface H13, and a fourth restraining surface H14.

The first restraining surface H11 is a surface that restrains the take-up shaft 35A from moving in one direction parallel to a third direction (see FIG. 8) along a straight line connecting the rotation axis X1 of the supply reel 31 and the rotation axis X2 of the take-up reel 35 as located when the holder 100 is supporting the film cartridge 200. The second restraining surface H12 is a surface that restrains the take-up shaft 35A from moving in the other direction parallel to the third direction as located when the holder 100 is supporting the film cartridge 200.

The third restraining surface H13 is a surface that restrains the take-up shaft 35A from moving in one direction parallel to the first direction (see FIG. 8) perpendicular to the third direction and to the rotation axis X1 as located when the holder 100 is supporting the film cartridge 200. The fourth restraining surface H14 is a surface that restrains the take-up shaft 35A from moving in the other direction parallel to the first direction as located when the holder 100 is supporting the film cartridge 200.

The first restraining surface H11 and the second restraining surface H12 are located apart from the take-up shaft 35A in the third direction as located when the film unit FU is located in place in the housing main body 21. The third restraining surface H13 and the fourth restraining surface H14 are located apart from the take-up shaft 35A in the first direction as located when the film unit FU is located in place in the housing main body 21.

As shown in FIG. 13(*b*), one of end portions of the take-up shaft 35A on which the take-up gear 35C of the take-up shaft 35A is provided includes a small-diameter portion A1, a middle-diameter portion A2, and a large-diameter portion A3. The small-diameter portion A1 is a portion to be guided by the second guide GD2 (see FIG. 2), and is formed in a cylindrical shape. The small-diameter portion A1 protrudes outward in a direction along the axial direction beyond the take-up gear 35C.

The middle-diameter portion A2 is formed in a shape of a circular cylinder having a diameter larger than that of the small-diameter portion A1 and smaller than that of the large-diameter portion A3. The take-up gear 35C is located on an end face of the middle-diameter portion A2 facing outward in a direction along the axial direction. The large-diameter portion A3 is formed in a shape of a circular cylinder having a diameter larger than that of the middle-diameter portion A2 and smaller than that of the flange 35B. The large-diameter portion A3 is located between the middle-diameter portion A2 and the flange 35B arranged along the axial direction.

The side wall 122 of the restraining frame 120 has formed therein a recess 122B in which the middle-diameter portion A2 is placed. The recess 122B in combination with the recess 112E formed in the second holding portion 112 forms a hole H2 that holds the take-up shaft 35A. This hole H2 is a hole in which the take-up shaft 35A is engageable with clearance allowed therebetween. The take-up shaft 35A is configured to be movable inside the hole H2 in directions perpendicular to the axial direction.

The recess 112E formed in the base frame 110 includes a first restraining surface H21. The recess 122B formed in the restraining frame 120 includes a second restraining surface H22, a third restraining surface H23, and a fourth restraining surface H24.

The first restraining surface H21 is a surface that restrains the take-up shaft 35A (specifically, the large-diameter portion A3) from moving in one direction parallel to the third direction (see FIG. 8). The second restraining surface H22 is a surface that restrains the take-up shaft 35A (specifically, the middle-diameter portion A2) from moving in the other direction parallel to the third direction.

The third restraining surface H23 is a surface that restrains the take-up shaft 35A (specifically, the middle-diameter portion A2) from moving in one direction parallel to the first direction (see FIG. 8). The fourth restraining surface H24 is a surface that restrains the take-up-shaft 35A (specifically, the middle-diameter portion A2) from moving in the other direction parallel to the first direction.

When the film unit FU is located in place in the housing main body 21, the first restraining surface H21 and the second restraining surface H22 are located apart from the take-up shaft 35A in the third direction. When the film unit FU is located in place in the housing main body 21, the third restraining surface H23 and the fourth restraining surface H24 are located apart from the take-up shaft 35A in the first direction.

Figure 11:
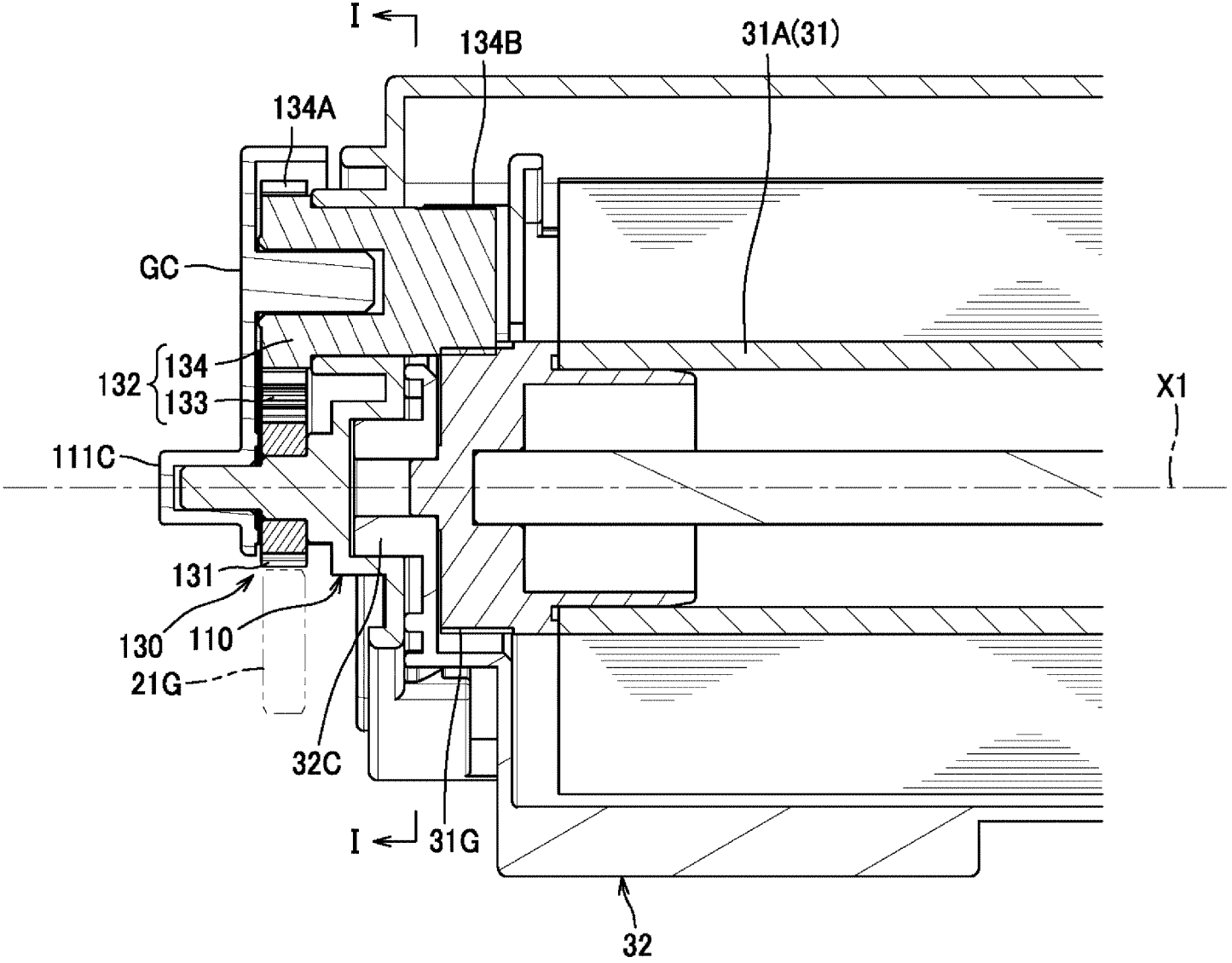
FIG. 11 is a section view showing a supply gear side structure of a supply reel.
Figure 14:
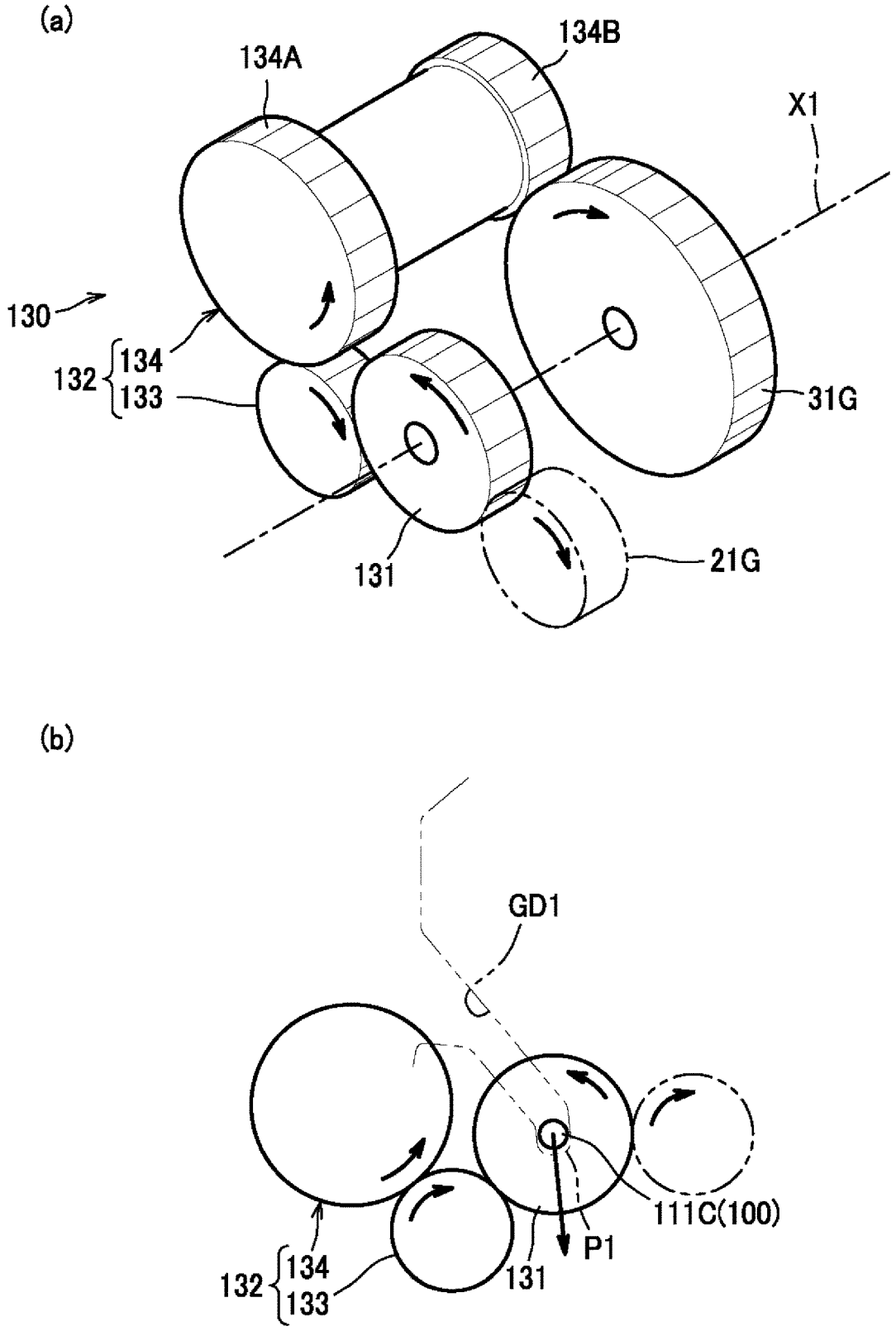
FIG. 14 includes: a perspective view (a) showing a gear mechanism; and a side view (b) showing a relationship between the gear mechanism and a first locating portion.

As shown in FIG. 11 and FIG. 14, the gearing system 130 for imposing a load on the supply reel 31 includes a holder gear 131 and a gear train 132. The holder gear 131 is a gear that engages with a housing gear 21G provided in the housing main body 21. The holder gear 131 is connected to the torque limiter or the like via the housing gear 21G.

The gear train 132 is a gear train that connects the holder gear 131 and the supply gear 31G in such a manner that a direction of rotation of the supply gear 31G is opposite to a direction of rotation of the holder gear 131. Such opposite directions of rotation of the supply gear 31G and the holder gear 131 serve to restrain, as shown in FIG. 14(*b*), the supply reel 31 from moving in a disengaging direction off the first guide GD1 (see FIG. 2), specifically, the boss 111C from moving in a disengaging direction off the first locating portion P1, when the multilayer film F is drawn out from the supply reel 31. To be more specific, when the holder 100 supporting the film cartridge 200 is located in place in the housing main body 21, rotation of the supply gear 31G caused by the multilayer film F drawn out from the supply reel 31 causes the holder gear 131 to rotate in a direction opposite to the direction of rotation of the supply gear 31G, thereby causing the boss 111C of the holder 100 to be biased toward the first locating portion P1.

The gear train 132 includes a first gear 133 and a second gear 134. The first gear 133 engages with the holder gear 131. The second gear 134 is a two-stage gear cluster and includes a large-diameter gear 134A and a small-diameter gear 134B.

The large-diameter gear 134A is a gear having a diameter larger than a diameter of the small-diameter gear 134B. The large-diameter gear 134A engages with the first gear 133. The small-diameter gear 134B engages with the supply gear 31G.

The holder gear 131 is arranged coaxially with the supply gear 31G. The supply gear 31G and the holder gear 131 as located when the holder 100 supporting the film cartridge 200 is located in place in the housing main body 21 are configured to rotate about the rotation axis X1 of the supply reel 31. The boss 111C and the engageable portion 32C as located when the holder 100 is supporting the film cartridge 200 are positioned on the rotation axis X1 of the supply reel 31.

Next, an operation of changing a film unit FU is explained.

As shown in FIG. 1, when the multilayer film F in the film unit FU has been used up for foil transfer and completely exhausted, a user raises the cover 22 of the housing 2 up to open the third opening 21A of the housing main body 21. Then, the user causes the film unit FU to be guided by the guides GD1, GD2 of the housing main body 21 and removed from the housing main body 21.

In this operation, the user can grasp the two handles 114 shown in FIG. 5 to remove the film unit FU; therefore operation for removing of the film unit FU can be performed easily.

Subsequently, the user rotates the supply case 32 approximately 45 degrees relative to the holder 100 of the film unit FU, as shown in FIG. 7(*b*), to align the orientation of the engageable portion 32C with the guide groove G1. Next, the user causes the engageable portion 32C to be guided by the guide groove G1, to remove the supply case 32 in a direction along the direction DD of movement.

In this operation, the supply case 32 passes through the region AR2 between broken lines in the drawing; therefore, interference of the supply case 32 with the first guide shaft 41 can be restrained. Moreover, the direction DD of movement is a direction of a vector which does not contain a component of a vector the direction DR2 of which is opposite to a direction DR1 in which the multilayer film F is drawn out from the supply reel 31; therefore, when the supply case 32 is removed from the holder 100, the tension applied to the portion of the multilayer film F between the first guide shaft 41 and the supply reel 31 gradually becomes lower. Accordingly, the user can remove the supply case 32 from the holder 100 easily.

Thereafter, as shown in FIG. 8 and FIG. 9(*a*), the user rotates the restraining frame 120 from the restraining position to the release position. Herein, the one end 120E of the restraining frame 120 in the restraining position is located closer than the farthest position B1 of the take-up reel 35 to the supply reel 31; therefore, even when the first surface 110A of the base frame 110 is placed on a surface of a table or other installation surface, the restraining frame 120 can be rotated largely, and the operation of removing the take-up reel 35 can be performed easily.

When the restraining frame 120 is moved to the release position, the third guide shaft 43 is moved together with the restraining frame 120 to the second position; therefore, the take-up reel 35 can be removed easily. In particular, when the third guide shaft 43 is in the second position, the inter-axial distance between the second guide shaft 42 and the third guide shaft 43 is greater than the maximum roll diameter of the multilayer film F wound on the take-up reel 35; therefore, the take-up reel 35 can be removed easily through between the second guide shaft 42 and the third guide shaft 43. The operation of installing a new film cartridge 200 into the holder 100, and the operation of installing the film unit FU into the housing main body 21 may be performed by following the above-described steps of operation in reverse; therefore, a description thereof is omitted herein.

Next, the operation of installing a film unit FU into the housing main body 21 is described.

As shown in FIG. 15(*a*), when the film unit FU is installed into the housing main body 21, a user first inserts the boss 111C into the first guide GD1. Thereafter, the user causes the boss 111C to be guided by the first guide GD1, and causes the take-up reel 35 to gradually rotate downward about the boss 111C, so that the take-up shaft 35A moves closer to the second guide GD2.

After the boss 111C is placed in the first locating portion P1, the user causes the take-up reel 35 to further rotate downward, to thereby cause the take-up shaft 35A and the hole HP to engage with the locating portions P2, P3. Accordingly, the boss 111C, the take-up shaft 35A, and the hole H are engaged with the corresponding locating portions P1-P3, and the film unit FU is located in place in the housing main body 21.

During this operation of locating in place, the take-up shaft 35A configured to be movable relative to the holder 100 moves moderately so that the take-up shaft 35A can be engaged with the second locating portion P2 easily. It is to be understood that the operation of removing the film unit FU from the housing main body 21 may be performed by following the above-described steps of operation in reverse; therefore, a description thereof is omitted herein.

According to the present embodiment described above, the following advantageous effects, in addition to the advantageous effects described above, can be achieved.

Since the multilayer film F is wound on the supply shaft 31A in such a manner that the supported layer F2 contacts the supply shaft 31A, the multilayer film F is wound, with the supporting layer F1 facing outside and the supported layer F2 facing inside, on the supply reel 31, so that unintentional touching of a user on the supported layer F2 can be restrained. In this embodiment, the multilayer film F wound on the supply reel 31 is covered with the supply case 32, and thus such unintentional touching of a user on the supported layer F2 does not occur; even in an alternative embodiment without the supply case 32, unintentional touching of a user on the supported layer F2 can be restrained because the supported layer F2 is protected by the supporting layer F1.

Since the multilayer film F is wound on the take-up shaft 35A in such a manner that the supported layer F2 contacts the take-up shaft 35A, the supporting layer F1 of the multilayer film F wound on the take-up reel 35 is positioned outside the supported layer F2 of the multilayer film F, so that the supported layer F2 left on the supporting layer F1 can be restrained from coming off, by the supporting layer F1.

Since the film cartridge 200 is configured to be installable into and removable from the holder 100, the holder 100 is rendered reusable, and thus environmentally friendly in comparison, for example, with a film unit without the feature of a film cartridge installable into and removable from a holder.

Since the first guide shaft 41 is located in the region AR defined by causing the supply case 32 to be projected in a perpendicular direction perpendicular to a plane FF containing the rotation axes X1, X2 (see FIG. 3), the supply case 32 can be located closer to the take-up reel 35 in the direction of a straight line connecting the rotation axes X1, X2, so that the upsizing of the film unit FU can be restrained.

Since the installation/removal guide G comprises the guide groove G1 and the circular holding hole G2, the engageable portion 32C may be inserted into the guide groove G1, and when the engageable portion 32C reaches the holding hole G2, the supply case 32 may be rotated so that the engageable portion 32C is made unremovable from the guide groove G1 in the predetermined direction. Therefore, the supply case 32 can be installed into and removed from the installation/removal guide G with simple operations.

Since the rotation of the supply case 32 is restrained by the restraining portion 150, the longitudinal direction of the engageable portion 32C can be made nonparallel to the predetermined direction, so that the engageable portion 32C can be restrained from getting disengaged from the installation/removal guide G.

In the above-described embodiment, the downstream end E2 of the first opening 32D is located between the multilayer film F positioned along the internal common tangent L1 of the first guide shaft 41 and the supply shaft 31A and the external common tangent L2 of the first guide shaft 41 and the supply shaft 31A which external common tangent is one located farther than the other from the take-up reel 35. Accordingly, the downstream end E2 can be located in such a position as not to interfere with, and as close as possible to, the last section of the multilayer film F just short of exhaustion; therefore, the size of the first opening 32D can be reduced, and the rigidity of the supply case 32 can be enhanced.

When the third guide shaft 43 is in the first position, the multilayer film F bent at the second guide shaft 42 can be angled acutely; therefore, when the multilayer film F laminated on a sheet S in the foil transfer process is separated from the sheet S after the foil transfer process, the transfer layer F22 can be peeled neatly from the sheet S.

Since a space is formed between the first holding portion 111 and the second holding portion 112, the heating roller 61 can be located between the first holding portion 111 and the second holding portion 112 in the layer transfer device 1.

Since the lock member 140 is configured to engage with the base frame 110 by making use of the biasing force from the multilayer film F, the cost can be reduced in comparison, for example, with an alternative configuration in which a spring or the like is provided so as not to allow the restraining frame to rattle in the restraining position.

Since the transfer layer F22 can be seen through the second opening 120A of the restraining frame 120 and visually recognizable through the transparent supporting layer F1 and release layer F21, a user can be made unlikely to choose a wrong kind (color) of transfer layer F22 when changing the multilayer film F.

Since the size of the second opening 120A is defined as described above, interference of the multilayer film F with the edges of the second opening 120A can be restrained even when the roll diameter of the multilayer film F wound on the take-up reel 35 gradually increases.

Since the handles 114 protrude in a position shifted from the multilayer film F laid on the first guide shaft 41 and the second guide shaft 42 in a direction away from the first guide shaft 41 and the second guide shaft 42, a user grasping the handles 114 can be made unlikely to touch the multilayer film F.

Since the holder 110 of the film unit FU is located in place by the first locating portion P1 and the take-up reel 35 is located in place by the second locating portion P2, the film unit FU removably installed in a direction perpendicular to the rotation axis X1 of the supply reel 31 can be satisfactorily located in place in the housing main body 21. Since the take-up reel 35 comprising the take-up gear 35C is located in place by the second locating portion P2 directly in the housing main body 21, the take-up gear 35C can be located properly in place relative to the driving source 80 (more specifically, the driving gear DG for transmitting a driving power from the driving source 80 to the take-up gear 35C), so that a driving power from the driving source 80 can be reliably transmitted to the take-up reel 35.

With the above-described configuration, in which take-up reel 35 is movable relative to the holder 100 (to be more specific, movable in an amount which can absorb the effect of tolerances of the film unit FU and the housing 2 and which is determined with consideration given to the first guide GD1 that is bent), the holder 100 and the take-up reel 35 can be properly located in place at their corresponding locating portions P1-P3. Herein, the amount determined with consideration given to the first guide GD1 that is bent is an amount corresponding to the difference between the distance from the first locating portion P1 to the second locating portion P2 and the distance from the first portion GD11 to the second locating portion P2.

Since the take-up shaft 35A provided coaxially with the take-up gear 35C is guided and located in place, the take-up gear 35C can be properly located in place relative to the driving gear DG in comparison with an alternative configuration in which a portion of the take-up reel 35 not coaxial with the take-up gear 35C is guided and located in place.

Since the first guide GD1 is bent at a position between the first portion GD11 and the second portion GD12, the boss 111C of the holder 100 can be restrained from getting displaced from the first locating portion P1.

Since the take-up shaft 35A not yet placed at the second locating portion P2 is movable relative to the second locating portion P2 in one direction and in the other direction along the third direction, the take-up shaft 35A can be placed at the second locating portion P2 properly even when the boss 111C of the holder 100 is in the first guide GD1 or the first locating portion P1.

Since the take-up shaft 35A of the take-up reel 35 in the film unit FU located in place in the housing main body 21 does not contact the restraining surfaces H11-H14, H21-H24, the wearing away of the respective restraining surfaces during rotation of the take-up reel 35 can be restrained.

Since the take-up reel 35 located at the front side when the boss 111C of the film unit FU is engaged with the first guide GD1 at the side of the cover 22 closer to the rotation axis X3, i.e., at the rear side of the layer transfer device 1 can be rotated about the boss 111C and engaged with the second guide GD2, the operation of installing the film unit FU can be performed easily.

Since the direction of rotation of the supply gear 31G is opposite to the direction of rotation of the holder gear 131, it is possible to bias the boss 111C of the holder 100 toward the first locating portion P1 while keeping the direction of rotation of the supply gear 31G fixed to such a direction as to forward the multilayer film F, so that the boss 111C can be restrained from coming off the first locating portion P1 when the supply gear 31G rotates.

Since the supply gear 31G, the holder gear 131 and the boss 111C are located on the rotation axis X1 of the supply reel 31, the supply gear 31G, the holder gear 131 and the boss 111C can be located precisely in place.

A detailed description will be given of a second embodiment with reference made to the drawings where appropriate. In the following description, a general setup of a layer transfer device will be briefly described at the outset, particularly to bring the features different from those of the first embodiment into focus, and the characteristic features of this embodiment will be described thereafter.

Figure 16:
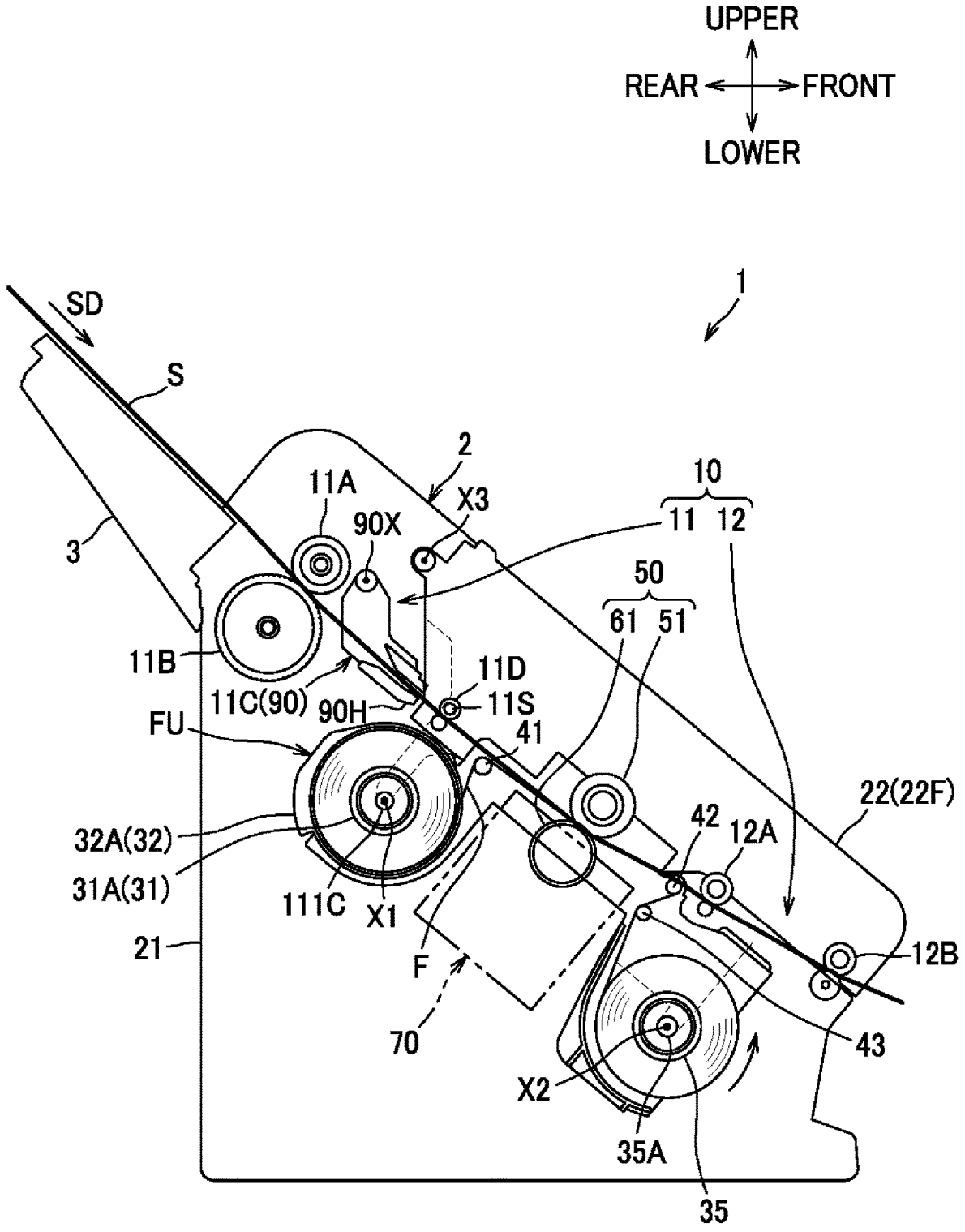
FIG. 16 is a diagram showing a layer transfer device according to a second embodiment of the present invention.

As shown in FIG. 16, a layer transfer device 1 includes a housing 2, a sheet tray 3, a sheet conveyor unit 10, a film unit FU, and a transfer unit 50.

The housing 2 includes a housing main body 21 and a cover 22. The housing main body 21 has a third opening 21A at its upper side (see FIG. 17). The third opening 21A is an opening for allowing the film unit FU which will be described later to be installed into or removed from the housing main body 21, and thus is configured to allow the film unit FU to pass therethrough. The housing main body 21 includes a first guide GD1 and a second guide GD2 (see FIG. 17, FIG. 22) as an example of a housing guide groove configured to guide installation and removal of the film unit FU which will be described later.

The cover 22 is a member for opening and closing the third opening 21A. The cover 22 includes a cover frame 22F made of sheet metal, and a rear end portion of the cover frame 22F is rotatably supported at an upper rear position of the housing main body 21. The cover 22 is configured to be rotatable relative to the housing main body 21 about a rotation axis X3 oriented along a direction parallel to a rotation axis X1 of a supply reel 31 which will be described later, between a closed position in which to close the third opening 21A (position shown in FIG. 16) and an open position in which to open the third opening 21A (position shown in FIG. 17). The cover frame 22F rotates together (integrally) with the cover 22 according as the cover 22 is opened or closed.

The sheet tray 3 is a tray on which sheets such as paper, OHP film, etc., are placed. The sheet tray 3 is provided at a rear portion of the housing 2. The sheets S of which surfaces having toner images formed thereon face downward are placed on the sheet tray 3.

The sheet conveyor unit 10 includes a sheet feed mechanism 11 and a sheet ejection mechanism 12. The sheet feed mechanism 11 is a mechanism that conveys sheets on the sheet tray 3 one by one toward the transfer unit 50. The sheet feed mechanism 11 includes a pickup roller 11A, a conveyor roller 11B, a conveyor member 11C, and a conveyor roller 11D.

The pickup roller 11A and the conveyor roller 11B, as well as the conveyor member 11C are supported, respectively, at predetermined positions of the housing main body 21. The conveyor roller 11D is supported at a predetermined position of the cover 22 (cover frame 22F) rotatably about a roller shaft 11S thereof. In the present embodiment, the conveyor member 11C is a conveyor guide 90 that directs a sheet S downstream in a sheet conveyance direction SD between the conveyor roller 11B and the conveyor roller 11D. Detail configurations of the conveyor guide 90 will be described later.

The sheet ejection mechanism 12 is a mechanism that ejects a sheet S which has passed through the transfer unit 50, to the outside of the housing 2. The sheet ejection mechanism 12 includes a plurality of conveyor rollers 12A, 12B, and a conveyor guide that directs a sheet S downstream in the sheet conveyance direction SD between the conveyor roller 12A and the conveyor roller 12B. These elements of the sheet ejection mechanism 12 are supported, respectively, at predetermined positions of the cover 22.

The film unit FU is a unit that supplies and lays a multilayer film F onto a sheet S conveyed from the sheet feed mechanism 11.

Figure 17:
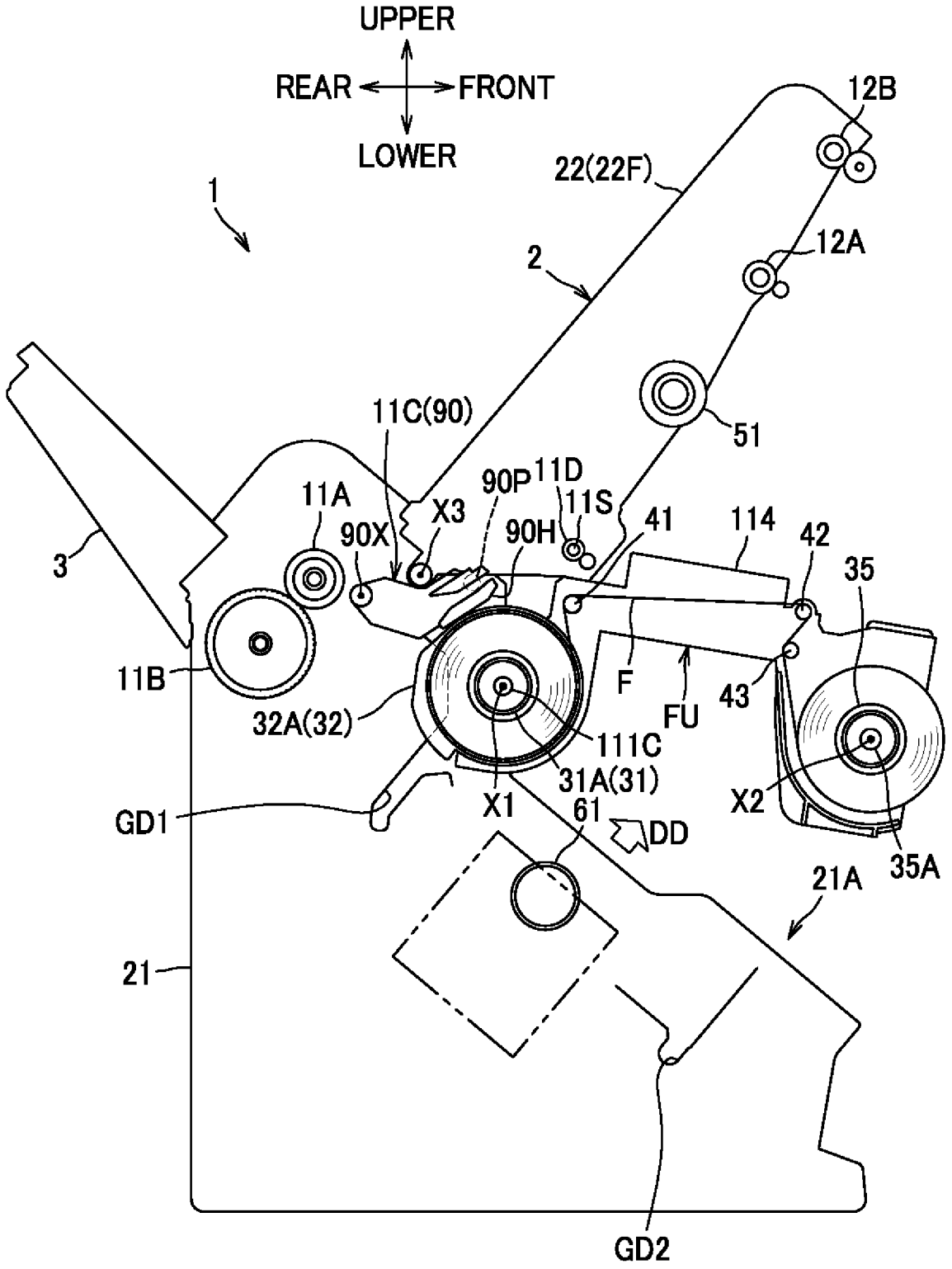
FIG. 17 is a diagram showing an open cover state of the layer transfer device.

The film unit FU is configured, as shown in FIG. 17, to be installable into and removable from the housing main body 21 along a direction perpendicular to a direction of the rotation axis X1 of a supply reel 31 which will be described later through the third opening 21A. The film unit FU mainly includes a supply reel 31 on which a multilayer film F is wound, a take-up reel 35, a first guide shaft 41, a second guide shaft 42, and a third guide shaft 43.

When the film unit FU is installed in the housing main body 21, the supply reel 31 is located in a position upstream in the sheet conveyance direction SD from, i.e., closer to the rotation axis X3 of the cover 22 than, the take-up reel 35.

The multilayer film F is a film consisting of a plurality of layers, and includes a supporting layer F1 and a supported layer F2. The supported layer F2 includes a release layer F21, a transfer layer F22, and an adhesive layer F23. The structure of the multilayer film F is substantially the same as the structure of the first embodiment described above with reference to FIG. 3, and thus a duplicate description will be omitted herein.

The supply reel 31 is made of plastic or the like, and includes a supply shaft 31A on which a multilayer film F is wound. One end of the multilayer film F is fixed to the supply shaft 31A. The multilayer film F is wound, with the supporting layer F1 facing outside and the supported layer F2 (transfer layer F22) facing inside, on the supply reel 31. The supply reel 31, i.e., the supply shaft 31A, is supported rotatably about the rotation axis X1 by a holder 100, which will be described later, of the film unit FU.

The take-up reel 35 is made of plastic or the like, and includes a take-up shaft 35A on which to take up the multilayer film F. The other end of the multilayer film F is fixed to the take-up shaft 35A. The multilayer film F is to be wound, with the supporting layer F1 facing outside and the supported layer F2 (transfer layer F22) facing inside, on the take-up reel 35. The take-up reel 35, i.e., the take-up shaft 35A, is supported rotatably about the rotation axis X2 parallel to the rotation axis X1 by the holder 100 which will be described later, of the film unit FU.

It is to be understood that in FIG. 16 or other drawing figures, the supply reel 31 and the take-up reel 35 are illustrated as if the both reels were wound up to the maximum. In actuality, the film unit FU in new condition has its multilayer film F wound on the supply reel 31 in a roll of a maximum diameter, while no multilayer film F is wound on the take-up reel 35, or the multilayer film F is wound on the take-up reel 35 but in a roll of a minimum diameter. When the film unit FU is at the end of its life (i.e., the multilayer film F has been exhausted), the multilayer film F is wound on the take-up reel 35 in a roll of a maximum diameter, while no multilayer film F is wound on the supply reel 31, or the multilayer film F is wound on the supply reel 31 but in a roll of a minimum diameter.

The first guide shaft 41 is a shaft for changing a traveling direction of the multilayer film F drawn out from the supply reel 31. The first guide shaft 41 contacts the supporting layer F1 of the multilayer film F. The first guide shaft 41 is made of plastic or the like.

The second guide shaft 42 is a shaft for changing a traveling direction of the multilayer film F guided by the first guide shaft 41. The second guide shaft 42 contacts the supporting layer F1 of the multilayer film F. The second guide shaft 42 is made of plastic or the like.

The third guide shaft 42 is a shaft that changes a traveling direction of the multilayer film F guided by the second guide shaft 42 toward the take-up reel 35 when the holder 100 is supporting the film cartridge 200. The third guide shaft 43 contacts the supported layer F2 (adhesive layer F23) of the multilayer film F. The third guide shaft 43 is made of plastic or the like.

The take-up reel 35 of the film unit FU installed in the layer transfer device 1 is caused to rotate counter clockwise as in the drawing by a driving source (not shown) provided in the housing 2. To be more specific, the take-up gear 35C (see FIG. 18) provided on the take-up shaft 35A of the take-up reel 35 engages with the driving gear supported in the housing main body 21, whereby a driving power is transmitted thereto, and the take-up reel 35 is caused to rotate.

As the take-up reel 35 rotates, the multilayer film F wound on the supply reel 31 is drawn out, and the multilayer film F thus drawn out is taken up on the take-up reel 35. To be more specific, during the layer transfer process, the multilayer film F is forwarded by a pressure roller 51 and a heating roller 61 whereby the multilayer film F is drawn out from the supply reel 31. The multilayer film F forwarded through the pressure roller 51 and the heating roller 61 are taken up on the take-up reel 35.

The first guide shaft 41 guides the multilayer film F drawn out from the supply reel 31 and laid under a sheet S being conveyed with a toner image facing downward. The first guide shaft 41 changes a direction of travel of the multilayer film F drawn out from the supply reel 31, and guides the multilayer film F in a direction along (substantially parallel to) the sheet conveyance direction SD.

The second guide shaft 42 contacts the multilayer film F having passed through the transfer unit 50, and changes a direction of travel of the multilayer film F having passed through the transfer unit 50 into a direction (direction toward the take-up reel 35) different from the sheet conveyance direction SD. The multilayer film F having passed through the transfer unit 50 and conveyed with the sheet S laid thereon is guided to the second guide shaft 42, and peeled from the sheet S.

The multilayer film F of the film unit FU installed in the layer transfer device 1 as shown in FIG. 16 has the supported layer F2 (i.e., transfer layer F22) facing in a direction DD of removal of the film unit FU (see FIG. 22) between the first guide shaft 41 and the second guide shaft 42.

The transfer unit 50 is a unit that heats and pressurizes the sheet and the multilayer film F laid on each other, to transfer the transfer layer F22 onto a toner image formed on a sheet S. The transfer unit 50 includes a pressure roller 51 and a heating roller 61. The transfer unit 50 applies heat and pressure to portions of a sheet S and a multilayer film F laid on each other and nipped between the pressure roller 51 and the heating roller 61.

The pressure roller 51 is a roller comprising a cylindrical metal core with its cylindrical surface coated with a rubber layer made of silicone rubber. The pressure roller 51 is located above the multilayer film F (on an upper side thereof on which the transfer layer F22 is provided), and is contactable with a reverse side (opposite to a side on which a toner image is formed) of the sheet S.

The pressure roller 51 has two end portions rotatably supported by the cover 22. The pressure roller 51, which in combination with the heating roller 61, nips the sheet S and the multilayer film F, is driven to rotate by a driving source (not shown) and causes the heating roller 61 to rotate accordingly.

The heating roller 61 is a roller comprising a cylindrical metal tube with a heater located inside, to heat the multilayer film F and the sheet S. The heating roller 61 is located under the multilayer film F, and is in contact with the multilayer film F.

In this embodiment, the heating roller 61 is moved by a contact/separation mechanism 70 for bringing the heating roller 61 into and out of contact with the multilayer film F. When the cover 22 is closed, the contact/separation mechanism 70 causes the heating roller 61 to move to a contact position in which it contacts the multilayer film F, at each time when a sheet S is fed to the transfer unit 50. On the other hand, when the cover 22 is opened, or when foil transfer on a sheet S is not in process in the transfer unit 50, the contact/separation mechanism 70 causes the heating roller 61 to be positioned in a separate position in which it is separate from the multilayer film F.

With the layer transfer device 1 configured as described above, sheets S stacked on the sheet tray 3 with front surfaces (on which toner images are formed) facing downward are conveyed one by one toward the transfer unit 50 by the sheet feed mechanism 11. Specifically, a sheet S fed by the pickup roller 11A and the conveyor roller 11B into the housing 2 is directed by the conveyor guide 90 downstream in the sheet conveyance direction SD. Each sheet S passed from the conveyor guide 90 to the conveyor roller 11D is further conveyed by the conveyor roller 11D, and is laid on a multilayer film F supplied from the supply reel 31 at a position upstream of the transfer unit 50 in the sheet conveyance direction SD, and is conveyed to the transfer unit 50 with a toner image of the sheet S being kept in contact with the multilayer film F.

In the transfer unit 50, the sheet S and the multilayer film F nipped and passing through between the pressure roller 51 and the heating roller 61 are heated and pressurized by the heating roller 61 and the pressure roller 51, so that a transfer layer is transferred onto the toner image.

After the transfer layer is transferred, the sheet S and the multilayer film F adhered to each other are conveyed to the second guide shaft 42. When the sheet S and the multilayer film F travels past the second guide shaft 42, the direction of travel of the multilayer film F is changed into a direction different from the sheet conveyance direction SD; thereby, the multilayer film F is peeled from the sheet S.

The multilayer film F peeled from the sheet S is taken up on the take-up reel 35. On the other hand, the sheet S from which the multilayer film F is peeled is conveyed by the sheet ejection mechanism 12 (i.e., conveyor rollers 12A, 12B), and is ejected, with a transfer layer-transferred surface thereof facing downward, to the outside of the housing 2.

The conveyor rollers 11B, 11D, 12A, 12B and the pressure roller 51 provided to convey a sheet S in the layer transfer device 1 are arranged such that distances between nipping positions of rollers adjacent to each other in the sheet conveyance direction SD are smaller than a minimum dimension of a sheet assumed to be subject to a process of transferring a transfer layer by the layer transfer device 1 (the minimum value of the length in the sheet conveyance direction SD).

Figure 18:
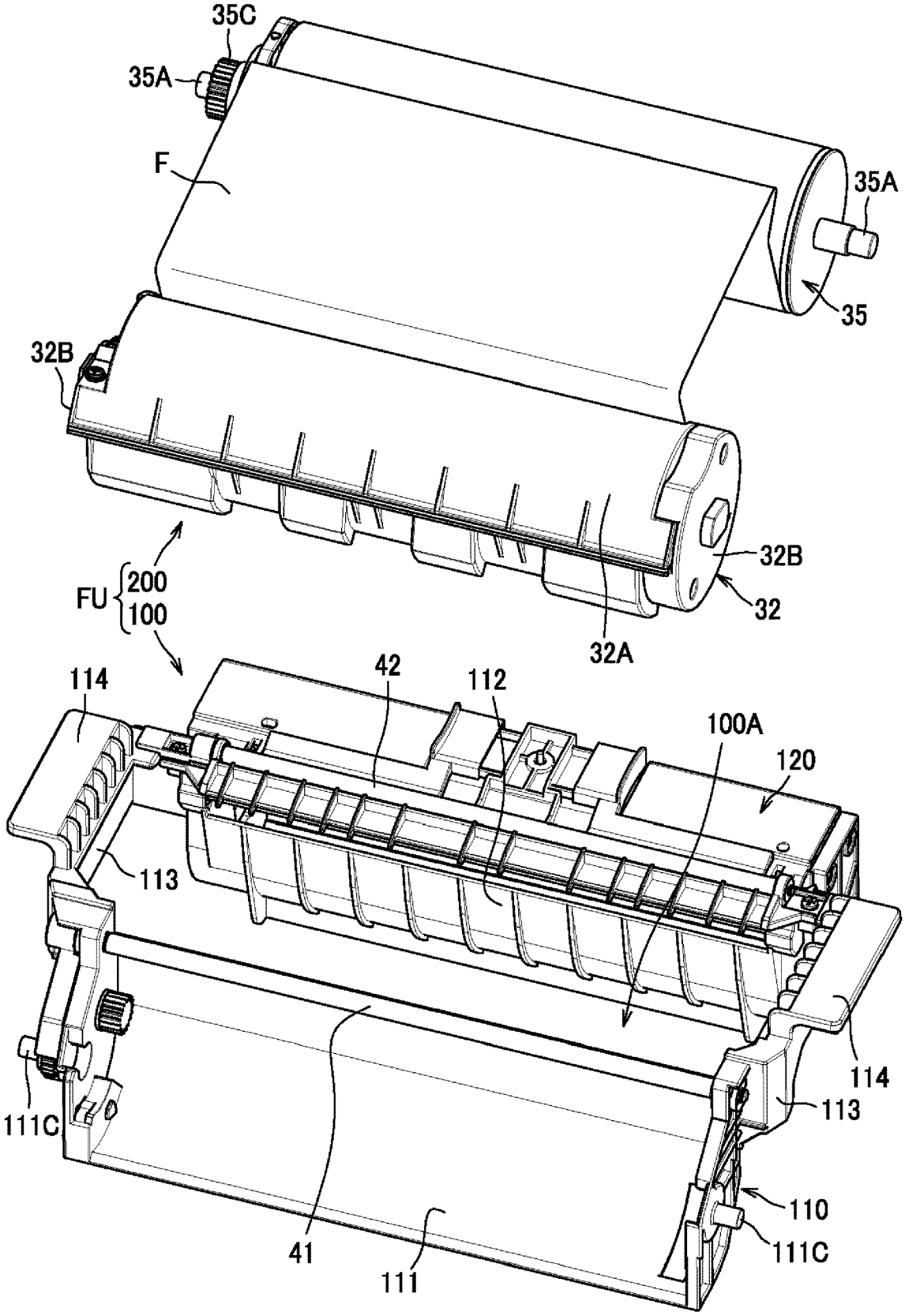
FIG. 18 is an exploded perspective view of a film unit.

As shown in FIG. 18, the film unit FU includes a holder 100 made of plastic or the like, and a film cartridge 200 installable into and removable from the holder 100. The film cartridge 200 includes a supply reel 31 and a take-up reel 35 on which a multilayer film F as described above is wound, and a supply case 32.

The supply reel 31 (more specifically, the supply case 32) and the take-up reel 35 are installable into and removable from the holder 100 in directions perpendicular to the axial direction of the supply reel 31. The film cartridge 200 attached to the holder 100 is installable into and removable from the housing main body 21.

The supply case 32 is a hollow case accommodating the supply reel 31. The supply case 32 is made of plastic or the like, and includes an outer peripheral wall 32A having a substantially cylindrical surface, and two side walls 32B each having a shape of a substantially circular disc and provided at both ends of the outer peripheral wall 32A. The supply reel 31 is rotatably supported by the respective side walls 32B of the supply case 32.

The holder 100 includes a base frame 110 and a restraining frame 120 rotatably (movably) supported by the base frame 110. The base frame 110 includes a first holding portion 111, a second holding portion 112, two connecting portions 113 and two handles 114.

The first holding portion 111 is a portion that holds the supply case 32. The first holding portion 111 holds the supply reel 31 via the supply case 32.

The second holding portion 112 is a portion that holds the take-up reel 35. To be more specific, the second holding portion 112 is combined with the restraining frame 120 to make up a hollow case, and the take-up reel 35 is accommodated in the hollow case.

The two connecting portions 113 are portions that connect the first holding portion 111 and the second holding portion 112. To be more specific, the connecting portions 113 are arranged apart from each other in the axial direction of the supply reel 31. In a position at an upper part of the first holding portion 111 and adjacent to the connecting portions 113, the first guide shaft 41 is located. In a position at an upper part of the second holding portion 112 and adjacent to the connecting portions 113, the second guide shaft 42 is located. The third guide shaft (not shown) is supported inside the restraining frame 120.

With the connecting portions 113 being formed in this way, the holder 100 is provided with a through hole 100A extending in a perpendicular direction perpendicular to the axial direction of the supply reel 31. When the film unit FU is installed in the housing 2 as shown in FIG. 16, the transfer unit 50 is located in the through hole 100A.

The first holding portion 111 comprises bosses 111C located coaxially with the rotation axis X1 of the supply reel 31 and protruding laterally outward. The bosses 111C are portions that serve in combination with the take-up shaft 35A of the take-up reel 35 as to-be-guided portions that are engaged with the first guide GD1 and the second guide GD2 and guided when the film unit FU of which the film cartridge 200 is installed in the holder 100 is installed or removed.

Each of the handles 114 is arranged on a corresponding connecting portion 113. The handles 114 are located respectively at opposite ends of the holder 100 apart from each other in the axial direction of the take-up reel 35.

Next, a description will be given of a structural feature of the conveyor guide 90 as an example of the conveyor member 11C. The conveyor guide 90 is guiding means for relaying a sheet S fed to the inside of the housing 2 by the conveyor roller 11B that is supported by the housing main body 21 at a position upstream in the sheet conveyance direction SD, to the conveyor roller 11D that is supported by the cover 22 at a position downstream in the sheet conveyance direction SD.

Figure 19:
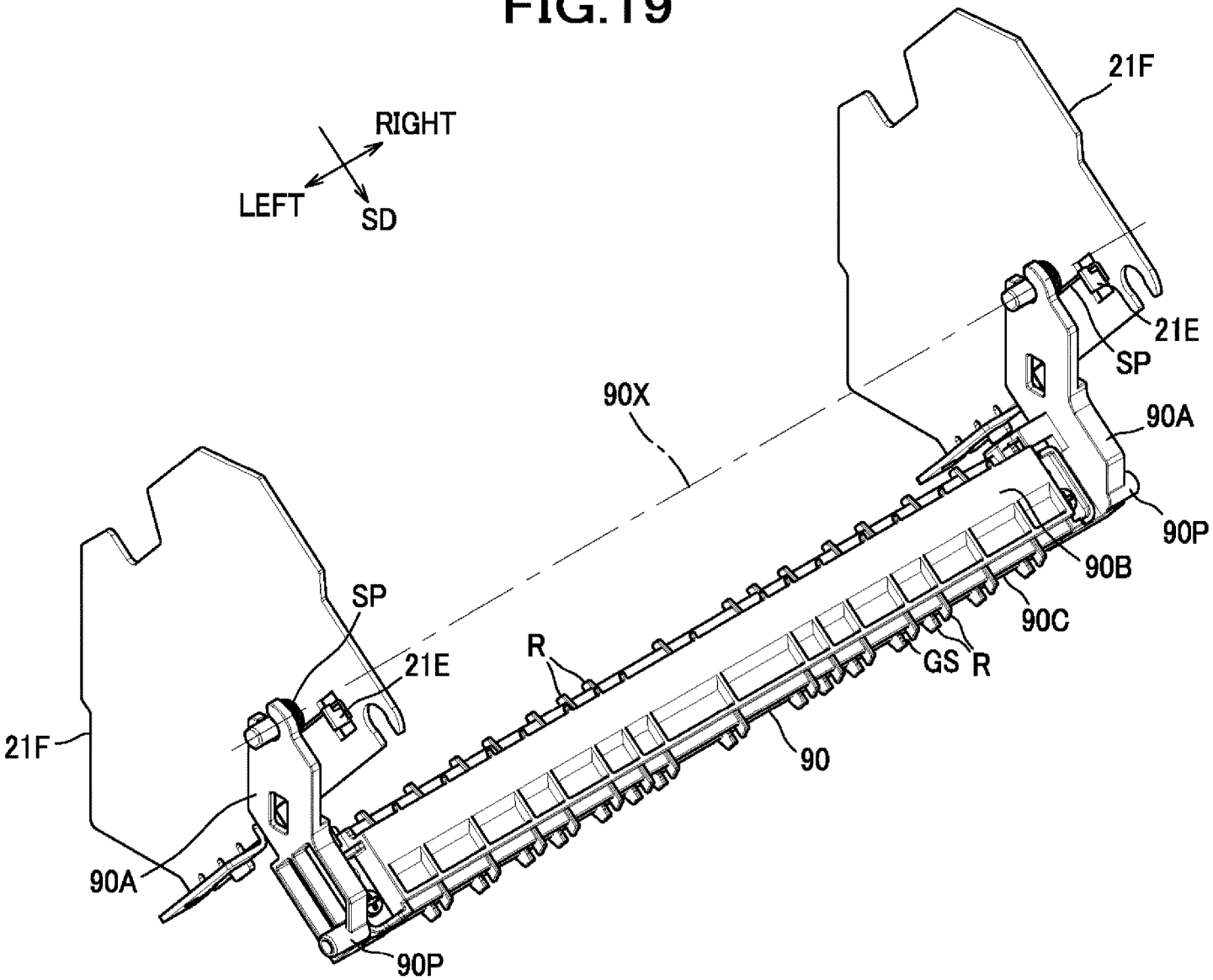
FIG. 19 is a perspective view showing a conveyor guide attached to a side frame of a housing main body.
Figure 20:
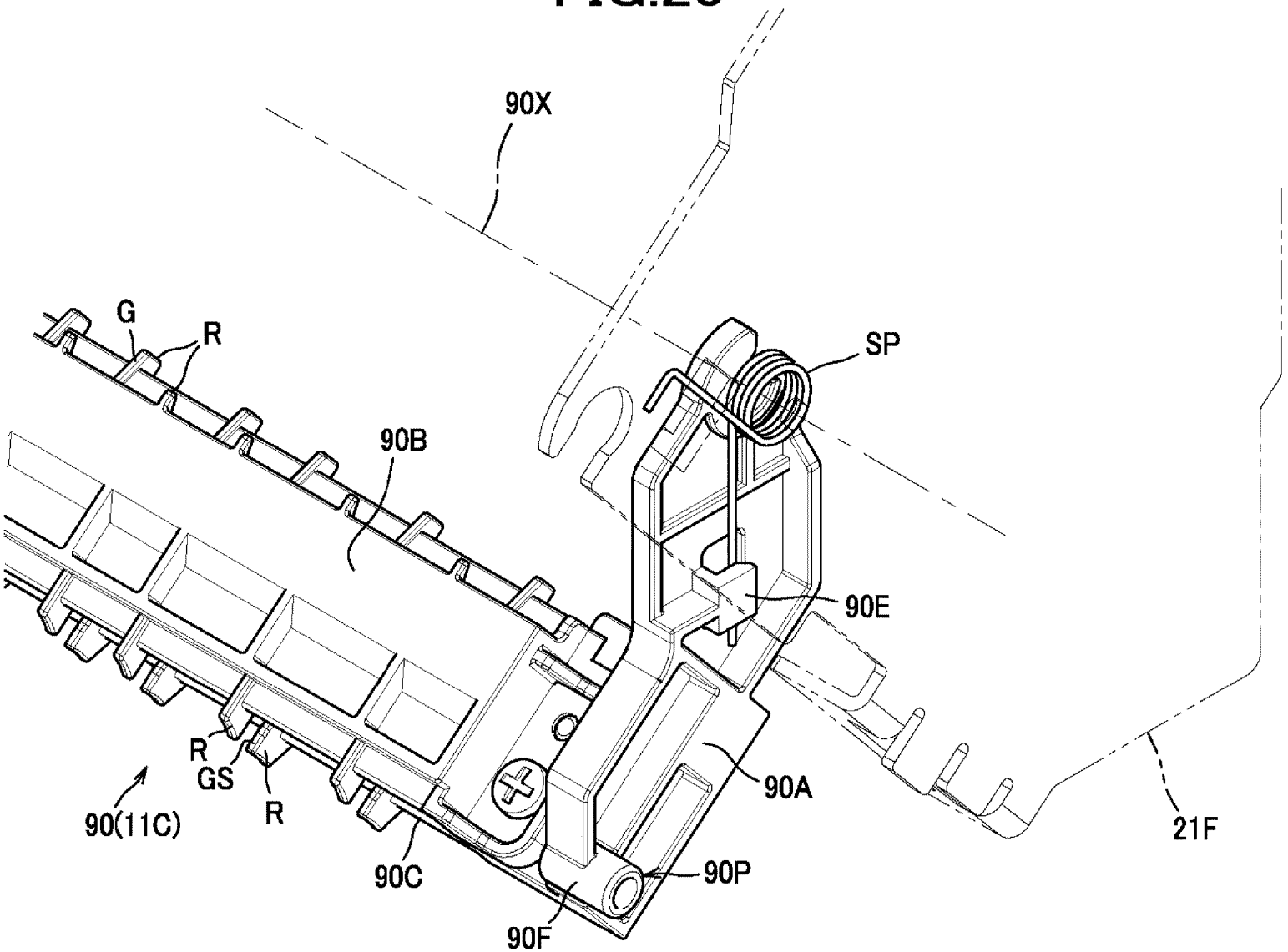
FIG. 20 is a diagram showing a torsion spring which biases the conveyor guide.

As shown in FIG. 19 and FIG. 20, the conveyor guide 90 includes left and right arms 90A, a plate-shaped upper guide 90B, a plate-shaped lower guide 90C, and left and right protrusions 90P. In the following description, unless otherwise specified clearly, the shape of each element is described as if the conveyor guide 90 is located in such a position that a sheet S can be directed downstream in the sheet conveyance direction SD when the cover 22 is closed as shown in FIG. 16.

The upper guide 90B and the lower guide 90C are retained substantially parallel to each other with such a gap provided therebetween as to allow a sheet S conveyed to pass therethrough, and left and right ends thereof are fixed respectively to distal end portions (free ends) of the left and right arms 90A.

The upper guide 90B and the lower guide 90C have a plurality of ribs R protruding from opposed surfaces thereof and arranged along the lateral direction at predetermined spacings. Each rib R extends continuously from upstream ends to downstream ends of the upper guide 90B and the lower guide 90C, and further extends continuously around the upstream ends and the downstream ends of the upper guide 90B and the lower guide 90C, to protrude upstream and downstream respectively beyond the upstream ends and the downstream ends of the upper guide 90B and the lower guide 90C.

The opposed edges of the ribs R of the upper guide 90B and the lower guide 90C are, at their upstream sides in the sheet conveyance direction SD, so sloped as to have their gaps widen gradually toward upstream ends. Accordingly, a sheet S being fed is smoothly caused to enter the gap between the upper guide 90B and the lower guide 90C and conveyed downstream. On the other hand, the opposed edges of the ribs R at their downstream sides in the sheet conveyance direction SD are located at a predetermined distance that is wide apart enough to let the sheet S out without getting hitched and narrow enough to cause the sheet S to be fed precisely up to the nipping position at the conveyor roller 11D.

Figure 21:
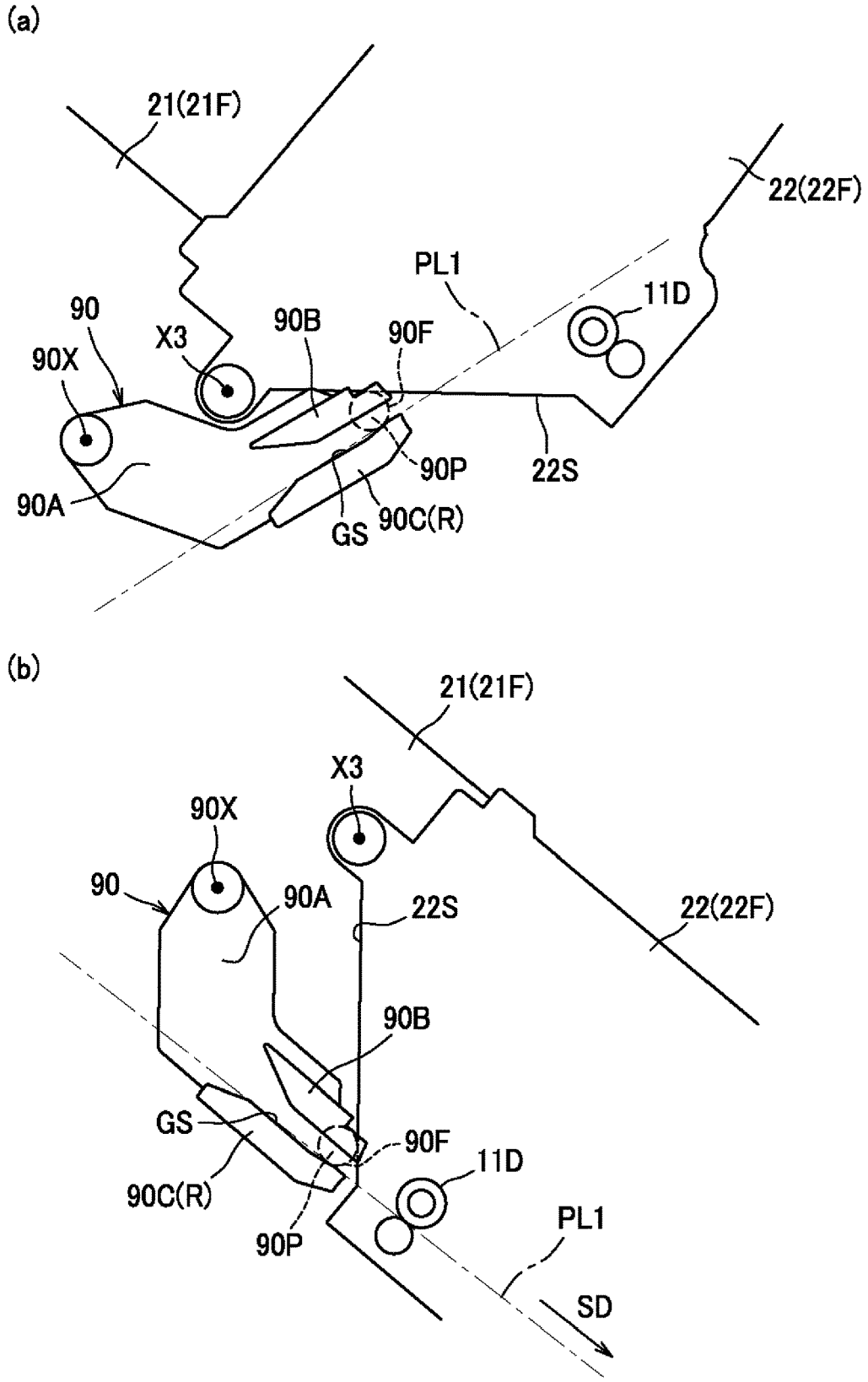
FIG. 21 includes diagrams of arrangement of the conveyor guide and a conveyor roller, as exhibited (a) when a cover is in an open position, and (b) when the cover is in a closed position.

The edges of the plurality of ribs R arranged along the lateral direction which face the conveyance path of the sheet S, particularly the edges of the ribs R protruding from the lower guide 90C toward the upper guide 90B, form a sheet guide surface GS (see FIG. 21). The conveyor guide 90 has, in a surface at a reverse side of the sheet guide surface GS (undersurface of the lower guide 90C), a unit guide surface 90H configured to guide installation and removal of the film unit FU (see FIG. 17).

The distal ends (free ends) of the left and right arms 90A are provided with protrusions 90P protruding laterally outward respectively. The protrusions 90P each have an external shape of a right circular cylinder of which a cross section perpendicular to the direction of the rotation axis X1 of the supply reel 31 has a circular shape (see also FIG. 17). That is, the protrusion 90P has an outer cylindrical surface 90F at its perimeter, and protrudes in a direction along the rotation axis X1 of the supply reel 31 as located when the holder 100 supporting the film cartridge 200 is located in place in the housing main body 21.

The proximal ends of the left and right arms 90A each extend from a portion thereof to which the upper guide 90A and the lower guide 90C are connected, i.e., a portion extending along the sheet conveyance direction SD, obliquely upward, specifically, extend in an oblique direction generally toward upstream in the sheet conveyance direction SD and angled to a side on which the rotation axis X3 of the cover 22 is provided, and are supported respectively by the left and right side frames 21F made of sheet metal of the housing main body 21, rotatably about the rotation axis 90X extending along the direction of the rotation axis X1 (see FIG. 16) of the supply reel 31 as located when the holder 100 supporting the film cartridge 200 is located in place in the housing main body 21. Accordingly, the conveyor guide 90 is supported rotatably about the rotation axis 90X relative to the housing main body 21.

The rotation axis 90X is positioned closer to the rotation axis X3 of the cover 22 than to the conveyance path of the sheet S (i.e., to the sheet guide surface GS) as located when the cover 22 is closed as shown in FIG. 21(*b*). The rotation axis 90X of the conveyor guide 90 is positioned upstream of the rotation axis X3 of the cover 22 in the sheet conveyance direction SD.

As shown in FIG. 19 and FIG. 20, torsion springs SP are provided, each as an example of a spring, around the rotation axis 90X respectively at the proximal ends of the left and right arms 90A. The torsion spring SP has one end engaged with a hook 90E provided in the arm 90A, and the other end engaged with a hook 21E provided in the side frame 21F.

The conveyor guide 90 is biased toward the cover 22 by the torsion spring SP. Therefore, irrespective of the movement associated with the opening/closing operation of the cover 22, the cylindrical surface 90F of the protrusion 90P of the conveyor guide 90 is always in contact with a surface (contact surface 22S) facing upstream in the sheet conveyance direction SD of the cover frame 22F supported pivotally on the side frames 21F of the housing main body 21, as shown in FIGS. 21(*a*), (*b*).

The contact surface 22S of the cover frame 22F is a surface that extends downward from the rotation axis X3 and faces rearward when the cover 22 is closed as shown in FIG. 21(*b*). The contact surface 22S is slanted relative to a direction toward the conveyance path of the sheet (i.e., to the sheet guide surface GS) toward downstream in the sheet conveyance direction SD (to a side on which the conveyor roller 11D is provided).

When the film unit FU is installed and the cover 22 of the housing 2 is closed as shown in FIG. 16, the conveyor guide 90 is located in a position (first position) in which a sheet S can be guided downstream in the sheet conveyance direction SD. In this situation, the conveyor guide 90 is located between the sheet tray 3 (specifically, the position where the pickup roller 11A and the conveyor roller 11B nip) and the first guide shaft 41 of the film unit FU. A sheet S placed on the sheet tray 3 is fed into the housing 2 by the pickup roller 11A and the conveyor roller 11B and guided by the conveyor guide 90 downstream in the sheet conveyance direction SD.

The sheet S thus guided by the conveyor guide 90 is conveyed by the conveyor roller 11D so that the surface thereof on which a toner image is formed comes in contact with a transfer layer F22 side of the multilayer film F stretched between the first guide shaft 41 and the second guide shaft 42. In the transfer unit 50, the sheet S with a transfer layer transferred onto the toner image is ejected by the sheet ejection mechanism 12 (conveyor rollers 12A, 12B) to the outside of the housing 2.

When the film cartridge 200 in the layer transfer device 1 is changed, the cover 22 of the housing 2 is opened, and the film unit FU is removed. When the cover 22 of the housing 2 is opened, the conveyor guide 90 is located in a second position shown in FIG. 17. The conveyor guide 90 (specifically, the sheet guide surface GS) in the second position is located closer, than in the first position, to the rotation axis X3 of the cover 22.

To be more specific, when the cover 22 moves from the closed state to the open state, the protrusion 90P provided at the distal end of the conveyor guide 90 (free end downstream in the sheet conveyance direction SD) moves toward the rotation axis X3 of the cover 22 along the contact surface 22S extending toward the rotation axis X3. As a result, the protrusion 90P of the conveyor guide 90 in the second position shown in FIG. 21(*a*) is located closer, than that of the conveyor guide 90 in the first position shown in FIG. 21(*b*), to the rotation axis X3.

The conveyor guide 90 in the first position is located such that a hypothetical plane PL1 containing the sheet guide surface GS for guiding a sheet S intersects the conveyor roller 11D (see FIG. 21(*b*)). On the other hand, the conveyor guide 90 in the second position is located such that the hypothetical plane PL1 does not intersect the conveyor roller 11D (see FIG. 21(*a*)).

The conveyor guide 90 as located when the cover 22 is closed is located in place by the protrusion 90P (see FIG. 21(*b*)) such that the hypothetical plane PL1 is oriented toward the conveyor roller 11D.

Figure 22:
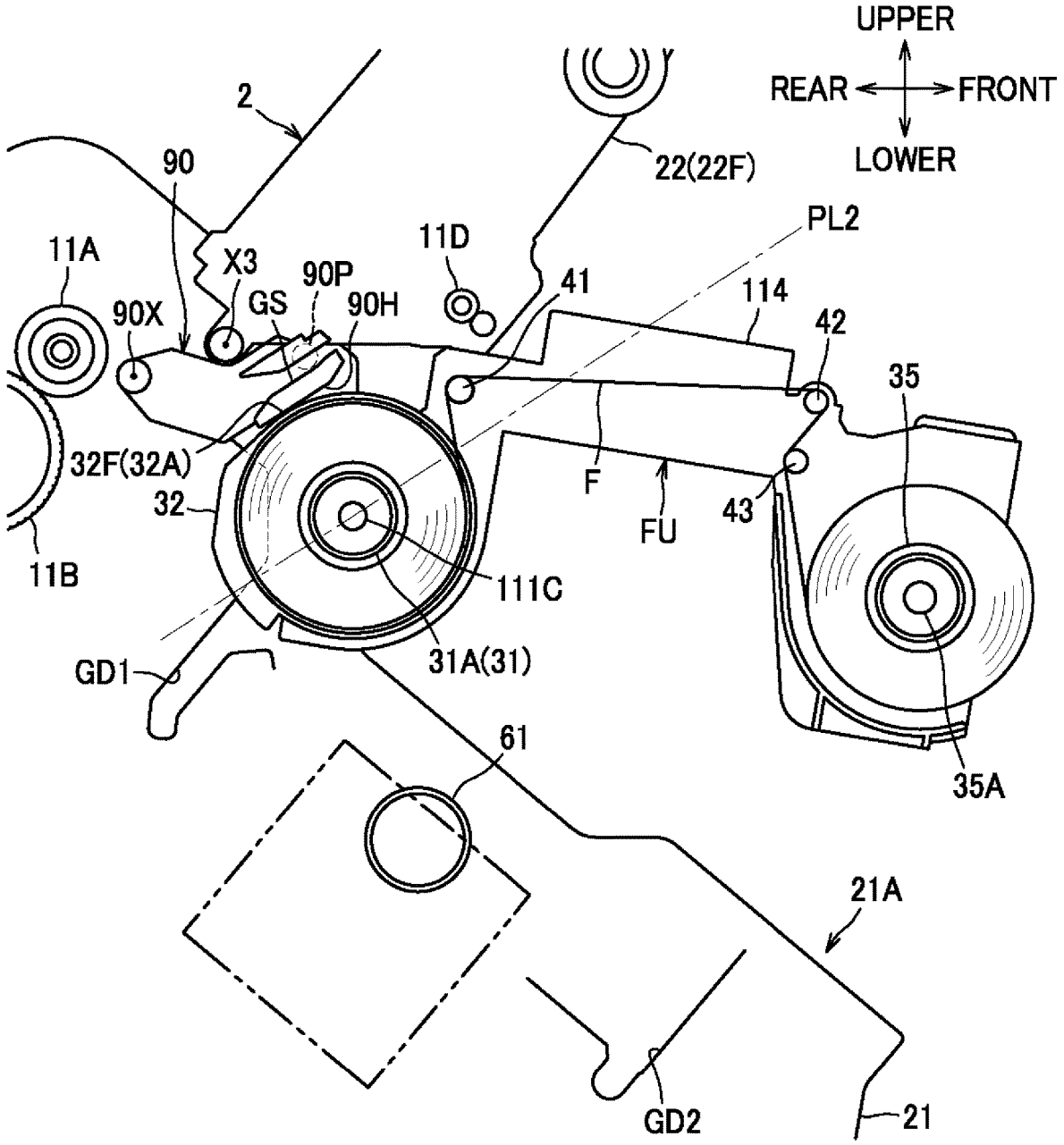
FIG. 22 is a diagram for explaining a mechanism for guiding an installation/removal path followed by the film unit to be installed and removed.

When the cover 22 is opened as shown in FIG. 17 and FIG. 22, a user can grip and pull the handles 114 of the film unit FU out, so as to remove the film unit FU. In this operation, the first guide GD1 and the second guide GD2 of the housing main body 21 guide the bosses 111C and the take-up shaft 35A of the film unit FU in a predetermined direction DD. Herein, the predetermined direction DD is a direction of the length of the first guide GD1 and the second guide GD2 along which the bosses 111C and the take-up shaft 35A engaged therewith slide, and a direction of movement, as restrained by the first guide GD1 and the second guide GD2, of the film unit FU removed from the housing main body 21.

When the bosses 111C and the take-up shaft 35A of the film unit FU come out of the first guide GD1 and the second guide GD2, an upper part of the rear portion (outer peripheral wall 32A of the supply case 32) of the film unit FU located at the rear of the housing main body 21 comes in contact with the unit guide surface 90H of the conveyor guide 90. At this time, the conveyor guide 90 is located with the unit guide surface 90H slanted relative to the predetermined direction DD as defined by the first guide GD1 and the second guide GD2. Therefore, the film unit FU coming out of the first guide GD1 and the second guide GD2 and thus becoming unguided can be guided in a direction away from the cover 22.

When the film unit FU is installed, the process of removing the film unit FU as described above may be performed in reverse. First, with the cover 22 opened as shown in FIG. 17, the handles 114 of the film unit FU are gripped, and the outer peripheral wall 32A of the supply case 32 is caused to slide along the unit guide surface 90H of the conveyor guide 90, and the bosses 111C and the take-up shaft 35A are inserted into the first guide GD1 and the second guide GD2, respectively (see FIG. 22; in this operation, the film unit FU is moved in a direction opposite to the arrow DD).

Hereupon, as shown in FIG. 22, the unit guide surface 90H of the conveyor guide 90 in the second position is located so as to be made contactable with the contact portion 32F of the outer peripheral wall 32A of the film unit FU which is being installed or removed. To be more specific, the unit guide surface 90H is located such that a hypothetical plane PL2 parallel to the unit guide surface 90H and apart from the unit guide surface 90H at a distance from the contact portion 32F to the bosses 111C as a guided portion intersects the first guide GD1 corresponding to the bosses 111C.

Accordingly, when the film unit FU is installed into the housing main body 21, the conveyor guide 90 serves to make the bosses 111C of the film unit FU easily engageable with the first guide GD1, so that the bosses 111C and the take-up shaft 35A can be inserted smoothly into the first guide GD1 and the second guide GD2.

When the cover 22 is closed after installation of the film unit FU, the conveyor guide 90 moves, with the cylindrical surface 90F of the protrusion 90P sliding along the contact surface 22S of the cover frame 22F, in synchronization with the closing operation of the cover 22 by the action of the torsion spring SP, and comes back to the first position shown in FIG. 16. The action of the torsion spring SP is retained still in the first position; with the protrusion 90P of the conveyor guide 90 being pressed against the contact surface 22S of the cover frame 22F, the downstream end (free end) of the conveyor guide 90 is located precisely in place.

Thus-achieved precise location of the conveyor guide 90 results in proper orientation of the sheet guide surface GS of the conveyor guide 90 as arranged to guide a sheet S toward a position in which the sheet S is nipped by the conveyor roller 11D (see the hypothetical plane PL1 in FIG. 21(*b*)).

Herein, since the downstream end (free end) of the conveyor guide 90 is located in place by the cover frame 22F that supports the conveyor roller 11D, the conveyor guide 90 can be located precisely in place relative to the conveyor roller 11D in comparison with an alternative configuration in which a member other than the cover member 22F is provided therebetween. Therefore, precise conveyance of a sheet S fed from the housing main body 21 to the conveyor roller 11D provided on the cover 22 is realized.

According to the present embodiment, the following advantageous effects, in addition to the aforementioned effects, can be achieved.

Provision of the film unit FU configured as the film cartridge 200 installed in the holder 100 eliminates the necessity for a user to wind the multilayer film F on the first guide shaft 41, the second guide shaft 42 and the third guide shaft 43 when the film unit FU is installed into or removed from the housing 2 as shown in FIG. 17. Furthermore, since this operation can be performed by gripping the handles 114, the operation of installation or removal can be completed easily and quickly without touching the multilayer film F with the transfer layer F22 exposed to the side facing the direction DD of removal of the film unit FU.

Since the conveyor guide 90 in the second position when the cover 22 is opened is located such that the hypothetical plane PL1 containing the sheet guide surface GS does not intersect the conveyor roller 11D, the conveyor guide 90 can be retreated effectively from the space which serves as an installation/removal path formed between the cover 22 and the housing main body 21 when the film unit FU is installed and removed.

The above-described embodiment can be modified for practical application.

In the above-described embodiment, the first guide shaft 41 as a whole is located in the region AR1 defined by causing the supply case 32 to be projected in the perpendicular direction perpendicular to the plane FF containing the rotation axes X1, X2; however, the first guide shaft 41 may be located partly in the region AR1.

In the above-described embodiment, the transfer layer F22 is explained as one which contains foil; however, the transfer layer may, for example, not contain foil or colorant, but may be formed of a thermoplastic resin, or may contain a varnish that is a material to be applied to form a transparent coating.

In the above-described embodiment, the multilayer film F is of four layers, but the multilayer film may include any number of layers as long as it includes a transfer layer and a supporting layer.

In the above-described embodiment, the layer transfer device 1 is configured as a device separate from an image forming apparatus such as a laser printer, etc.; however, the layer transfer device may be configured as an integral unit combined with an image forming apparatus.

Although the above-described embodiment is configured such that the supply reel 31 and the take-up reel 35 are installable into and removable from the holder 100 in a direction perpendicular to the axial direction of the supply reel 31, another configuration may be feasible such that the supply reel and the take-up reel are installable into and removable from the holder along the axial direction of the supply reel.

Figure 23:
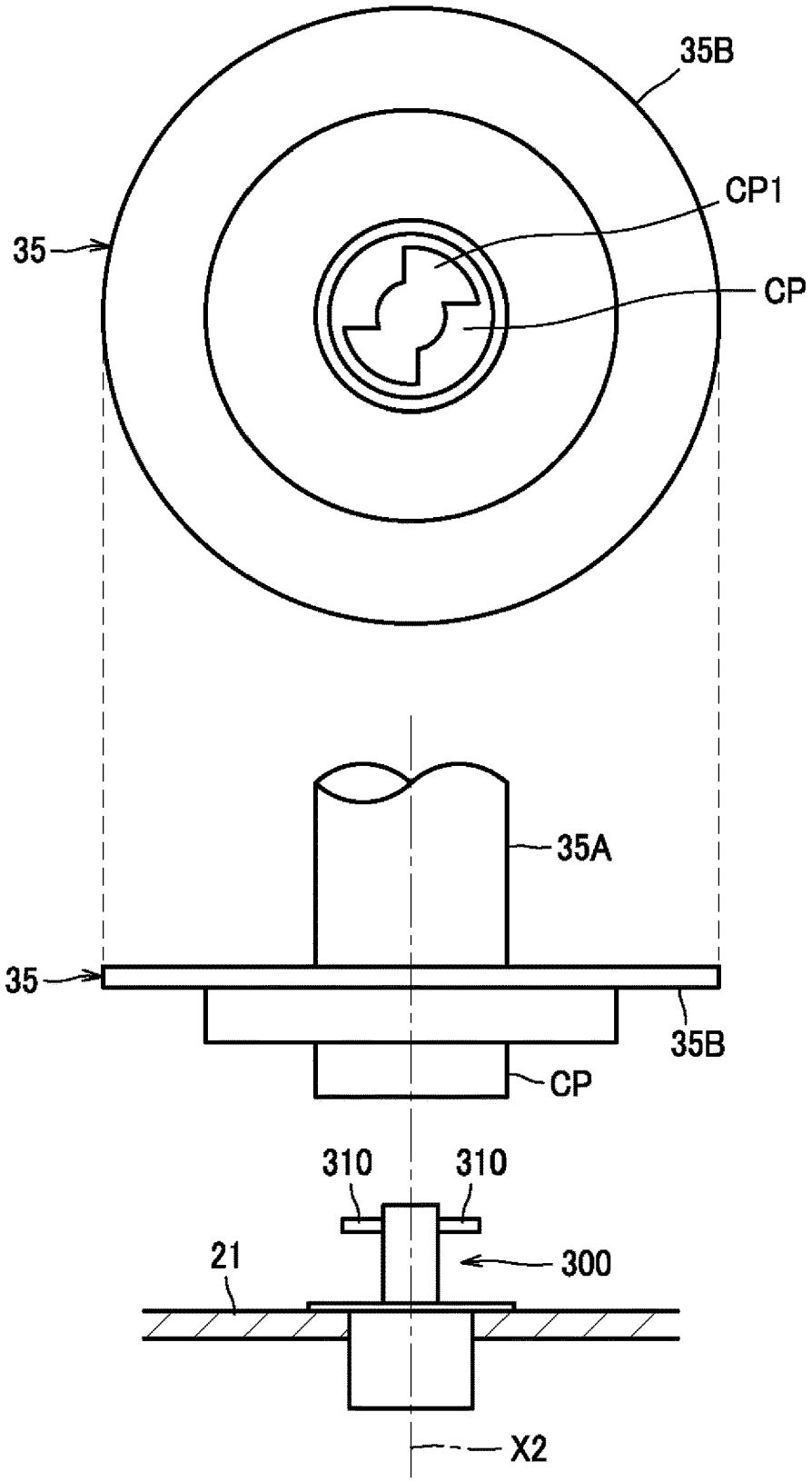
FIG. 23 is a diagram showing a modified example of a driving power input member.

In the above-described embodiment, the take-up gear 35C is illustrated as an example of a driving power input member; however, the driving power input member may, for example, be a coupling CP as shown in FIG. 23. To elaborate, the coupling CP is provided at an end of the take-up shaft 35A.

The coupling CP comprises a hole CP1 engageable with a driving power output member 300 in the direction of rotation of the take-up reel 35. The driving power output member 300 is provided in the housing main body 21. The driving power output member 300 is configured to be able to advance and retreat in directions along the rotation axis X2 of the take-up reel 35. The driving power output member 300 comprises an engageable portion 310 engageable with the hole CP1 of the coupling CP in the direction of rotation described above. In this embodiment as well, similar to the above-described embodiment, the take-up reel 35 is located in place directly at the housing main body 21, and thus the coupling CP and the driving power output member 300 can be located in place precisely relative to each other.

In the above-described embodiment, the torsion spring SP is illustrated as an example of a spring; however, the spring may, for example, be a coil spring, a leaf spring, or a wire spring, etc.

In the above-described embodiment, the conveyor guide 90 is illustrated as an example of a conveyor member 11C; however, the conveyor member may be a conveyor roller.

The elements described in the above embodiment and modified examples may be implemented selectively and in combination.

What is claimed is:

1. A layer transfer device for transferring a transfer layer onto a toner image formed on a sheet, the layer transfer device comprising:

a housing;

a film cartridge comprising: a supply reel including a supply shaft on which a multilayer film including a supported layer including a transfer layer, and a supporting layer supporting the supported layer is wound; and a take-up reel including a take-up shaft on which to take up the multilayer film; and a holder configured to support the film cartridge, the holder being installable into and removable from the housing while supporting the film cartridge.

2. The layer transfer device according to claim 1, wherein the holder comprises: a first guide shaft configured to contact the supporting layer of the multilayer film drawn out from the supply reel and change a traveling direction of the multilayer film; and a second guide shaft configured to contact the supporting layer of the multilayer film guided by the first guide shaft and change the traveling direction of the multilayer film.

3. The layer transfer device according to claim 2, wherein the film cartridge is installable into and removable from the holder.

4. The layer transfer device according to claim 3, wherein the film cartridge is installable into and removable from the holder along a direction perpendicular to an axial direction of the supply reel.

5. The layer transfer device according to claim 4, wherein the film cartridge comprises a supply case accommodating the supply reel, the supply case being installable into and removable from the holder, wherein the holder comprises an installation/removal guide configured to guide the supply case along a predetermined direction when the supply case is installed and removed, and wherein a direction of movement of the supply case guided by the installation/removal guide when the supply case is removed from the holder is a direction of a vector which does not contain a component of a vector a direction of which is opposite to a direction in which the multilayer film is drawn out from the supply reel.

6. The layer transfer device according to claim 5, wherein the first guide shaft is located out of a region defined by causing the supply case installed in the holder to be projected in the predetermined direction.

7. The layer transfer device according to claim 5, wherein at least part of the first guide shaft is located in a region defined by causing the supply case to be projected in a perpendicular direction perpendicular to a plane containing a rotation axis of the supply reel and a rotation axis of the take-up reel as located when the holder is supporting the film cartridge.

8. The layer transfer device according to claim 5, wherein the supply case comprises an engageable portion having an elongate shape, wherein the installation/removal guide comprises:

a guide groove configured to guide the engageable portion along the predetermined direction; and a holding hole having a shape of a circle, connected to the guide groove, and configured to hold the engageable portion in a manner that permits the engageable portion to rotate, wherein the guide groove has a width smaller than a longer side of the engageable portion, and greater than a shorter side of the engageable portion, and wherein the holding hole has a diameter greater than the longer side of the engageable portion.

9. The layer transfer device according to claim 8, wherein the holder comprises a restraining portion that restrains rotation of the supply case with the engageable portion held in the holding hole, and wherein a longitudinal direction of the engageable portion of the supply case of which rotation is restrained by the restraining portion is nonparallel to the predetermined direction.

10. The layer transfer device according to claim 9, wherein the supply case comprises a first opening through which to draw out the multilayer film of the supply reel, wherein the first opening has an upstream end and a downstream end located downstream from the upstream end in a direction of rotation of the supply reel, wherein when the rotation of the supply case is restrained by the restraining portion, the downstream end is located between the multilayer film positioned along an internal common tangent of the first guide shaft and the supply shaft and an external common tangent of the first guide shaft and the supply shaft, the external common tangent being one located farther than the other from the take-up reel.

11. The layer transfer device according to claim 8, wherein the holder comprises a boss to be guided by a guide of the housing, and wherein the boss and the engageable portion are located on a rotation axis of the supply reel as located when the holder is supporting the film cartridge.

12. The layer transfer device according to claim 8, wherein the holder comprises a third guide shaft that contacts the supported layer of the multilayer film guided by the second guide shaft of the holder supporting the film cartridge, and changes a traveling direction of the multilayer film toward the take-up reel, and wherein the third guide shaft is movable between positions, as defined when the holder is supporting the film cartridge, the positions consisting of:

a first position, closer to the supply reel than, that is on a supply reel side with respect to, a straight line connecting a center of the take-up shaft and a center of the second guide shaft; and a second position that is on a side opposite to the supply reel side with respect to the straight line, and far apart from the second guide shaft at a distance greater than a maximum roll diameter of the multilayer film wound on the take-up reel.

13. The layer transfer device according to claim 12, wherein the holder comprises a base frame, and a restraining frame movably supported by the base frame, wherein the restraining frame comprises the third guide shaft, and is movable between positions, as defined when the holder is supporting the film cartridge, which consist of: a restraining position in which restraint is placed on movement of the take-up reel in installation/removal directions; and a release position in which the restraint on the movement of the take-up reel is lifted, and wherein when the restraining frame is in the restraining position, the third guide shaft is in the first position; when the restraining frame is in the release position, the third guide shaft is in the second position.

14. The layer transfer device according to claim 13, wherein the base frame comprises a first holding portion configured to hold the supply reel, a second holding portion configured to hold the take-up reel, and a connecting portion connecting the first holding portion and the second holding portion, and wherein the connecting portion is located off a plane containing a rotation axis of the supply reel held by the first holding portion and a rotation axis of the take-up reel held by the second holding portion, to one side.

15. The layer transfer device according to claim 13, wherein holder comprises a lock member provided on the restraining frame, the lock member being configured to engage with the base frame to restrain the restraining frame from moving from the restraining position to the release position, and wherein a biasing force applied from the multilayer film to the third guide shaft of the holder supporting the film cartridge causes the lock member to be biased toward the base frame.

16. The layer transfer device according to claim 13, wherein the restraining frame comprises one end located farthest from the supply reel supported by the holder when the restraining frame is in the restraining position, and wherein the one end comprises a second opening through which the take-up reel supported by the holder is exposed to outside.

17. The layer transfer device according to claim 16, wherein the supporting layer is transparent.

18. The layer transfer device according to claim 16, wherein when the holder is supporting the film cartridge, a first surface which the base frame comprises at an outer surface thereof, is located in a position shifted in a perpendicular direction perpendicular to a plane containing a rotation axis of the supply reel and a rotation axis of the take-up reel, on one side relative to the third guide shaft which is a same side as that on which the rotation axis of the take-up reel is located, the position being distanced farther than the rotation axis of the take-up reel from the third guide shaft, the restraining frame is rotatable relative to the base frame about a rotation axis distanced farther than the rotation axis of the take-up reel from the third guide shaft in the perpendicular direction, a farthest portion which the take-up reel comprises is located farthest from the supply reel, and the one end of the restraining frame is closer than the farthest portion to the supply reel when the restraining frame is in the restraining position.

19. The layer transfer device according to claim 18, wherein the second opening is wider than a width of the multilayer film, wherein the second opening has edges among which an edge oppositely laid across an outer surface of the multilayer film is positioned such that a distance therefrom to the rotation axis of the take-up reel supported by the holder is greater than a maximum roll radius of the multilayer film wound on the take-up reel.

20. The layer transfer device according to claim 2, wherein the holder comprises handles at opposite ends thereof apart from each other in an axial direction of the take-up reel as located when the holder is supporting the film cartridge.

21. The layer transfer device according to claim 20, wherein the handles protrude in a position shifted from the multilayer film laid on the first guide shaft and the second guide shaft of the holder supporting the film cartridge, in a direction away from the first guide shaft and the second guide shaft.

22. The layer transfer device according to claim 2, wherein the holder supporting the film cartridge is installable into and removable from the housing along a direction perpendicular to an axial direction of the supply reel.

23. The layer transfer device according to claim 2, further comprising:

a driving source; and a driving power transmission member configured to receive a driving power from the driving source and transmit the driving power to the take-up reel.

24. The layer transfer device according to claim 2, wherein the second guide shaft of the holder supporting the film cartridge is located in a position farther than the first guide shaft from the supply reel in a perpendicular direction perpendicular to a plane containing a rotation axis of the supply reel and a rotation axis of the take-up reel.

25. The layer transfer device according to claim 1, further comprising:

a heating member configured to heat the multilayer film; and a pressure member configured such that the multilayer film is nipped between the pressure member and the heating member, wherein the housing comprises a housing main body having a third opening, and a cover configured to open and close the third opening, and wherein the pressure member is provided in the cover.

26. The layer transfer device according to claim 1, comprising a driving source supported by the housing, to drive the take-up reel, wherein the take-up reel comprises a driving power input member configured to receive a driving power from the driving source, wherein the housing comprises:

a first guide configured to guide the holder along a first direction perpendicular to a rotation axis of the supply reel when the holder supporting the film cartridge is installed into and removed from the housing;

a second guide configured to guide the take-up reel along a second direction perpendicular to a rotation axis of the take-up reel when the holder supporting the film cartridge is installed into and removed from the housing;

a first locating portion including a guiding terminal end of the first guide to locate the holder in place; and a second locating portion including a guiding terminal end of the second guide to locate the take-up reel in place.

27. The layer transfer device according to claim 26, wherein the take-up reel is supported movably relative to the holder.

28. The layer transfer device according to claim 27, wherein the take-up shaft extends along a rotation axis of the take-up reel, wherein the driving power input member is located on the rotation axis of the take-up reel, wherein when the holder supporting the film cartridge is installed into and removed from the housing, the second guide guides the take-up shaft along the second direction, and the second locating portion locates the take-up shaft in place relative to the housing.

29. The layer transfer device according to claim 27, wherein the first guide comprises:

a first portion extending along the first direction; and a second portion connecting the first portion and the first locating portion, wherein the first locating portion is located closer than the first portion to the second locating portion, and wherein the second portion is slanted relative to the first direction.

30. The layer transfer device according to claim 29, wherein the holder comprises: a first restraining surface configured to restrain the take-up reel from moving in one direction parallel to a third direction along a straight line connecting a rotation axis of the supply reel and a rotation axis of the take-up reel as located when the holder is supporting the film cartridge; and a second restraining surface configured to restrain the take-up reel from moving in the other direction parallel to the third direction, and wherein when the holder supporting the film cartridge is located in place in the housing, both of the first restraining surface and the second restraining surface are located apart from the take-up reel in the third direction.

31. The layer transfer device according to claim 30, wherein the holder comprises: a third restraining surface configured to restrain the take-up reel from moving in one direction parallel to the second direction as located when the holder is supporting the film cartridge; and a fourth restraining surface configured to restrain the take-up reel from moving in the other direction parallel to the second direction as located when the holder is supporting the film cartridge, wherein when the holder supporting the film cartridge is located in place in the housing, both of the third restraining surface and the fourth restraining surface are located apart from the take-up reel in the second direction.

32. The layer transfer device according to claim 29, wherein the housing comprises: a housing main body having an opening configured to allow the holder supporting the film cartridge to pass therethrough; and a cover configured to be rotatable relative to the housing main body about a rotation axis oriented along a direction parallel to a rotation axis of the supply reel as located when the holder supporting the film cartridge is located in place in the housing, to open and close the opening, wherein the holder comprises a boss configured to be guided by the first guide, and is rotatable about the boss when the boss is guided by the first guide, and wherein the first guide is located closer than the second guide to the rotation axis of the cover.

33. The layer transfer device according to claim 32, wherein the supply reel comprises a supply gear configured to rotate together with the supply shaft about the rotation axis of the supply reel, wherein the holder comprises:

a holder gear configured to engage with a housing gear held by the housing; and a gear train configured to connect the holder gear and the supply gear in such a manner that a direction of rotation of the holder gear is opposite to a direction of rotation of the supply gear, and wherein when the holder supporting the film cartridge is located in place in the housing, rotation of the supply gear causes the boss of the holder to be biased toward the first locating portion.

34. The layer transfer device according to claim 33, wherein when the holder supporting the film cartridge is located in place in the housing, the supply gear and the holder gear are caused to rotate about the rotation axis of the supply reel, and the boss is located on the rotation axis of the supply reel.

35. The layer transfer device according to claim 26, comprising a driving gear supported by the housing and configured to transmit the driving power of the driving source, wherein the driving power input member is a take-up gear engageable with the driving gear.

36. The layer transfer device according to claim 26, comprising a driving power output member supported by the housing and allowed to move forward and backward along a direction parallel to the rotation axis of the take-up reel, wherein the driving power input member is a coupling engageable with the driving power output member in a direction of rotation of the take-up reel.

37. The layer transfer device according to claim 1, comprising a conveyor member for conveying a sheet, wherein the holder supporting the film cartridge is installable into and removable from the housing along a direction perpendicular to an axial direction of the supply reel, wherein the housing comprises: a housing main body having an opening configured to allow the holder supporting the film cartridge to pass therethrough; and a cover configured to open and close the opening, wherein the cover is rotatable relative to the housing main body about a rotation axis oriented along the axial direction of the supply reel when the holder supporting the film cartridge is located in place in the housing, and wherein the conveyor member is movable in synchronization with opening and closing of the cover, and configured to be located in a first position to allow the sheet to be directed downstream in a sheet conveyance direction when the cover is closed, and located in a second position closer than the first position to the rotation axis of the cover when the cover is opened.

38. The layer transfer device according to claim 37, wherein the conveyor member is rotatable relative to the housing main body about a rotation axis oriented along the axial direction of the supply reel when the holder supporting the film cartridge is located in place in the housing, and wherein the rotation axis of the conveyor member is located upstream relative to the rotation axis of the cover in the sheet conveyance direction.

39. The layer transfer device according to claim 38, comprising a spring configured to bias the conveyor member toward the cover.

40. The layer transfer device according to claim 39, wherein the cover comprises: a conveyor roller configured to convey a sheet; and a cover frame configured to support a roller shaft of the conveyor roller in a manner that permits the roller shaft to rotate, as well as to rotate together with the cover in synchronization with opening and closing the cover, wherein the conveyor member is a conveyor guide configured to guide the sheet to the conveyor roller, wherein the conveyor guide comprises a protrusion protruding along the axial direction of the supply reel when the holder supporting the film cartridge is located in place in the housing, the protrusion having a cylindrical surface, and wherein the cover frame has a contact surface that contacts the cylindrical surface of the protrusion.

41. The layer transfer device according to claim 37, wherein the cover comprises a conveyor roller configured to convey a sheet, wherein the conveyor member is a conveyor guide configured to guide the sheet to the conveyor roller, wherein the conveyor guide has a sheet guide surface configured to guide the sheet in the first position, and wherein a hypothetical plane containing the sheet guide surface intersects the conveyor roller when the conveyor guide is located in the first position, and does not intersect the conveyor roller when the conveyor guide is located in the second position.

42. The layer transfer device according to claim 41, comprising a film unit which includes the film cartridge and the holder, wherein the film unit is installable into and removable from the housing main body through the opening.

43. The layer transfer device according to claim 42, wherein the housing main body comprises a housing guide groove configured to guide a guided portion of the film unit along a predetermined direction when the film unit is installed into and removed from the housing main body, wherein the conveyor guide has, at a reverse side of the seat guide surface, a unit guide surface contactable with a contact portion of the film unit when the conveyor guide is located in the second position, and a hypothetical plane parallel to the unit guide surface of the conveyor guide in the second position intersects the housing guide groove, the hypothetical plane being located apart from the unit guide surface at a distance from the contact portion to the guided portion.

44. The layer transfer device according to claim 43, wherein the conveyor guide in the second position is located such that the unit guide surface is slanted relative to the predetermined direction.

45. The layer transfer device according to claim 37, wherein the rotation axis of the cover is located closer than the take-up reel to the supply reel when the holder supporting the film cartridge is located in place relative to the housing.

46. The layer transfer device according to claim 37, further comprising a first guide shaft and a second guide shaft, wherein when the holder supporting the film cartridge is located in place in the housing, the first guide shaft changes a traveling direction of the multilayer film drawn out from the supply reel to a direction along the sheet conveyance direction, and the second guide shaft changes the traveling direction of the multilayer film guided by the first guide shaft to a direction toward the take-up reel.

47. The layer transfer device according to claim 46, wherein when the holder supporting the film cartridge is located in place in the housing, the multilayer film between the first guide shaft and the second guide shaft has the supported layer oriented toward a direction in which the film cartridge is removed.

48. The layer transfer device according to claim 47, further comprising a seat tray on which a sheet to be fed into the housing is to be placed, wherein when the holder supporting the film cartridge is located in place in the housing, the conveyor member in the first position is located between the seat tray and the first guide shaft, and configured to convey the sheet fed of which a surface with the toner image formed thereon contacts a surface of the supported layer of the multilayer film stretched between the first guide shaft and the second guide shaft.

49. A layer transfer device for transferring a transfer layer onto an image formed on a sheet, the layer transfer device comprising:

a housing;

a film cartridge comprising: a supply reel including a supply shaft on which a multilayer film including a supported layer including a transfer layer, and a supporting layer supporting the supported layer is wound; and a take-up reel including a take-up shaft on which to take up the multilayer film; and a holder configured to support the film cartridge, the holder being installable into and removable from the housing while supporting the film cartridge.

50. The layer transfer device according to claim 49, wherein the holder comprises: a first guide shaft configured to contact the supporting layer of the multilayer film drawn out from the supply reel and change a traveling direction of the multilayer film; and a second guide shaft configured to contact the supporting layer of the multilayer film guided by the first guide shaft and change the traveling direction of the multilayer film.

51. The layer transfer device according to claim 50, wherein the film cartridge is installable into and removable from the holder.

52. The layer transfer device according to claim 51, wherein the film cartridge is installable into and removable from the holder along a direction perpendicular to an axial direction of the supply reel.

53. The layer transfer device according to claim 52, wherein the film cartridge comprises a supply case accommodating the supply reel, the supply case being installable into and removable from the holder, wherein the holder comprises an installation/removal guide configured to guide the supply case along a predetermined direction when the supply case is installed and removed, and wherein a direction of movement of the supply case guided by the installation/removal guide when the supply case is removed from the holder is a direction of a vector which does not contain a component of a vector a direction of which is opposite to a direction in which the multilayer film is drawn out from the supply reel.

54. The layer transfer device according to claim 53, wherein the first guide shaft is located out of a region defined by causing the supply case installed in the holder to be projected in the predetermined direction.

55. The layer transfer device according to claim 53, wherein at least part of the first guide shaft is located in a region defined by causing the supply case to be projected in a perpendicular direction perpendicular to a plane containing a rotation axis of the supply reel and a rotation axis of the take-up reel as located when the holder is supporting the film cartridge.

56. The layer transfer device according to claim 53, wherein the supply case comprises an engageable portion having an elongate shape, wherein the installation/removal guide comprises:

a guide groove configured to guide the engageable portion along the predetermined direction; and a holding hole having a shape of a circle, connected to the guide groove, and configured to hold the engageable portion in a manner that permits the engageable portion to rotate, wherein the guide groove has a width smaller than a longer side of the engageable portion, and greater than a shorter side of the engageable portion, and wherein the holding hole has a diameter greater than the longer side of the engageable portion.

57. The layer transfer device according to claim 49, further comprising:

a heating member configured to heat the multilayer film; and a pressure member configured such that the multilayer film is nipped between the pressure member and the heating member, wherein the housing comprises a housing main body having a third opening, and a cover configured to open and close the third opening, and wherein the pressure member is provided in the cover.

58. The layer transfer device according to claim 49, comprising a driving source supported by the housing, to drive the take-up reel, wherein the take-up reel comprises a driving power input member configured to receive a driving power from the driving source, wherein the housing comprises:

a first guide configured to guide the holder along a first direction perpendicular to a rotation axis of the supply reel when the holder supporting the film cartridge is installed into and removed from the housing;

a second guide configured to guide the take-up reel along a second direction perpendicular to a rotation axis of the take-up reel when the holder supporting the film cartridge is installed into and removed from the housing;

a first locating portion including a guiding terminal end of the first guide to locate the holder in place; and a second locating portion including a guiding terminal end of the second guide to locate the take-up reel in place.

59. The layer transfer device according to claim 49, comprising a conveyor member for conveying a sheet, wherein the holder supporting the film cartridge is installable into and removable from the housing along a direction perpendicular to an axial direction of the supply reel, wherein the housing comprises: a housing main body having an opening configured to allow the holder supporting the film cartridge to pass therethrough; and a cover configured to open and close the opening, wherein the cover is rotatable relative to the housing main body about a rotation axis oriented along the axial direction of the supply reel when the holder supporting the film cartridge is located in place in the housing, and wherein the conveyor member is movable in synchronization with opening and closing of the cover, and configured to be located in a first position to allow the sheet to be directed downstream in a sheet conveyance direction when the cover is closed, and located in a second position closer than the first position to the rotation axis of the cover when the cover is opened.

* * * * *